US009207592B2

(12) United States Patent
Nakamura et al.

(10) Patent No.: US 9,207,592 B2
(45) Date of Patent: Dec. 8, 2015

(54) FIXING DEVICE CAPABLE OF PREVENTING TEMPERATURE DROP DUE TO HEAT ABSORPTION AND IMAGE FORMING APPARATUS INCLUDING SAME

(71) Applicant: Sharp Kabushiki Kaisha, Osaka (JP)

(72) Inventors: Hirokazu Nakamura, Osaka (JP); Kousuke Namisaki, Osaka (JP); Motoki Ohta, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/141,894

(22) Filed: Dec. 27, 2013

(65) Prior Publication Data

US 2014/0193181 A1 Jul. 10, 2014

(30) Foreign Application Priority Data

| | | |
|---|---|---|
| Jan. 9, 2013 | (JP) | 2013-001683 |
| Jan. 9, 2013 | (JP) | 2013-001686 |
| Mar. 28, 2013 | (JP) | 2013-068763 |
| Nov. 12, 2013 | (JP) | 2013-233813 |

(51) Int. Cl.
*G03G 15/20* (2006.01)
*G03G 21/00* (2006.01)

(52) U.S. Cl.
CPC ..... *G03G 15/2025* (2013.01); *G03G 15/2032* (2013.01); *G03G 15/2035* (2013.01); *G03G 2215/2032* (2013.01)

(58) Field of Classification Search
CPC ..... G03G 15/2025; G03G 15/2075; G03G 21/0035; G03G 21/0058
USPC ..... 399/327
See application file for complete search history.

(56) References Cited

U.S. PATENT DOCUMENTS

2011/0229224 A1 9/2011 Watanabe

FOREIGN PATENT DOCUMENTS

| | | | |
|---|---|---|---|
| JP | 02149876 A | * | 6/1990 |
| JP | 09-006174 | | 1/1997 |
| JP | 10-186931 | | 7/1998 |
| JP | 2003-015453 | | 1/2003 |
| JP | 2003-295667 | | 10/2003 |
| JP | 2007-047450 | | 2/2007 |
| JP | 2007-304180 | | 11/2007 |
| JP | 2009-122554 | | 6/2009 |
| JP | 2011-215587 | | 10/2011 |
| JP | 2012-063374 | | 3/2012 |

* cited by examiner

*Primary Examiner* — Joseph S Wong
(74) *Attorney, Agent, or Firm* — Renner, Otto, Boisselle & Sklar, LLP

(57) ABSTRACT

A fixing device in accordance with the present invention comprises: a rotary member for transporting printing paper; a pressure member for press-contacting the rotary member to apply pressure onto the printing paper; and a cleaning member capable of freely moving into contact with, or away from, a peripheral surface of the rotary member and/or a peripheral surface of the pressure member. A toner image formed on the printing paper is fixed while the printing paper is being held between the rotary member and the pressure member. The fixing device further comprises a contact and separation unit for moving the pressure member into contact with, or away from, the rotary member. The cleaning member moves into contact with, or away from, the peripheral surface of the rotary member and/or the peripheral surface of the pressure member in conjunction with the contact and separation unit moving the pressure member into contact with, or away from, the rotary member.

18 Claims, 18 Drawing Sheets

FIXING DEVICE CAPABLE OF PREVENTING TEMPERATURE DROP DUE TO HEAT ABSORPTION AND IMAGE FORMING APPARATUS INCLUDING SAME

CROSS-REFERENCE TO RELATED APPLICATIONS

The present application hereby claims priority under 35 U.S.C. §119(a) on Japanese Patent Application, Tokugan, No. 2013-001683 filed Jan. 9, 2013, Japanese Patent Application, Tokugan, No. 2013-001686 filed Jan. 9, 2013, Japanese Patent Application, Tokugan, No. 2013-068763 filed Mar. 28, 2013, and Japanese Patent Application, Tokugan, No. 2013-233813 filed Nov. 12, 2013, the entire contents of which are hereby incorporated herein by reference.

TECHNICAL FIELD

The present invention relates to a fixing device including a rotary member for transporting printing paper, a pressure member for press-contacting the rotary member to apply pressure to printing paper, and a cleaning member disposed to freely move into contact with, or away from, the peripheral surface of the rotary member, and relates also to an image forming apparatus including such a fixing device.

BACKGROUND ART

In conventional copying machines, printers, or like image forming apparatus, an electrostatic latent image is formed on a photosensitive body and developed with toner. The tone image is then transferred onto a recording medium, such as printing paper, and fixed under the heat and pressure applied to the recording medium carrying the toner image thereon while the recording medium is passing through a nip section formed by fixing members (e.g., a heating roller and a pressure roller) of a fixing device. Some molten toner and/or paper particles could stick to the fixing members after the recording medium has passed between the fixing members for the fixing of the toner image. It then would follow that residual toner may stain an image.

To address this problem, a solution is being proposed whereby a cleaning roller or web is brought into contact with the fixing members to collect toner.

Japanese Patent Application Publication, Tokukai, No. 2011-215587 discloses a fixing device that includes: a contact roller for contacting a pressure member with a web intervening between the roller and the member; and a depressurizing mechanism for modifying the site where the pressure member press-contacts the fixing members. The contact roller follows the motion of the depressurizing mechanism so as to maintain a constant position, direction, and pressure throughout the contact with the pressure member. The nip section of the fixing device is heated during fixing. However, the contact roller needs to be heated more than it should be because the contact roller is always in contact with the nip section and acts as a heat sink. This extra heating requirement is an obstacle to energy saving. Besides, the heat transfer to the contact roller leads to non-uniform temperature distribution in the pressure member, which is undesirable.

Japanese Patent Application Publication, Tokukai, No. 2009-122554 discloses a fixing device that includes: a roll-shaped sheet section and a cleaning roller. A heating roller is in contact with one of the surfaces of the sheet section, whereas the cleaning roller is in contact with the other surface of the sheet section. The cleaning roller is structured capable of moving into contact with, or away from, the heating roller. The cleaning roller is disposed where it is in contact with the heating roller while printing paper is passing between the rollers and it is separated from the heating roller while printing paper is not passing between the rollers. In this fixing device, no consideration is paid to a mechanism that separates the heating roller and a pressure roller, so residual toner could move to the pressure roller which has a lower temperature than the heating roller.

The present invention, to address these problems, has an object to provide a fixing device, as well as image forming apparatus, capable of preventing a temperature drop due to heat absorption by distancing the cleaning roller during fixing.

SUMMARY OF INVENTION

A fixing device in accordance with the present invention includes: a rotary member for transporting printing paper; a pressure member for press-contacting the rotary member to apply pressure onto the printing paper; and at least one cleaning member capable of freely moving into contact with, or away from, a peripheral surface of the rotary member and/or a peripheral surface of the pressure member, wherein a toner image formed on the printing paper is fixed while the printing paper is being held between the rotary member and the pressure member, the fixing device further including a contact and separation unit for moving the pressure member into contact with, or away from, the rotary member, wherein the cleaning member moves into contact with, or away from, the peripheral surface of the rotary member and/or the peripheral surface of the pressure member in conjunction with the contact and separation unit moving the pressure member into contact with, or away from, the rotary member.

According to the arrangement, by distancing the cleaning member from the rotary member and/or the pressure member, the toner collected by the cleaning member is prevented from sticking again. In addition, the cleaning member operates in conjunction with the pressure member. Thus, a common drive mechanism may be readily used to drive various members in the contact and separation unit, which in turn leads to a more compact fixing device.

The fixing device in accordance with the present invention may be arranged so that the cleaning member is capable of freely moving into contact with, or away from, the peripheral surface of the rotary member and moves into contact with, or away from, the rotary member in conjunction with the contact and separation unit moving the pressure member into contact with, or away from, the rotary member.

According to the arrangement, by distancing the cleaning member from the rotary member, the toner collected by the cleaning member is prevented from sticking again to the rotary member. In addition, the cleaning member operates in conjunction with the pressure member. Thus, a common drive mechanism may be readily used to drive various members in the contact and separation unit, which in turn leads to a more compact fixing device.

The fixing device in accordance with the present invention may be arranged so that the cleaning member moves away from the rotary member in conjunction with the contact and separation unit press-contacting the pressure member and moves into contact with the rotary member in conjunction with the contact and separation unit separating from the pressure member.

According to the arrangement, the cleaning member is distanced from the rotary member while the pressure member is press-contacting the rotary member for fixing. Temperature drops in the rotary member due to heat absorption are therefore prevented. In addition, the pressure member is distanced after the fixing is finished. Thus, residual toner is prevented from moving from the rotary member to the pressure member.

The fixing device in accordance with the present invention may be arranged so that: the contact and separation unit has a contact and separation shaft that can be pivoted to move the pressure member into contact with, or away from, the rotary member; and the cleaning member is supported by a contact and separation interlocking section connected to the contact and separation shaft.

According to the arrangement, the cleaning member is supported by a contact and separation interlocking section. The pressure member therefore readily operates in conjunction with the action of the cleaning member.

The fixing device in accordance with the present invention may be arranged so that: the contact and separation interlocking section includes a first coupling section pivoting around the contact and separation shaft and a second coupling section pulled by the first coupling section; the first coupling section is secured at an end thereof to the contact and separation shaft and coupled at the other end to an end of the second coupling section; the second coupling section supports at the other end thereof a rotational shaft of the cleaning member; and the cleaning member is regulated in terms of range of motion in which the cleaning member moves into contact with, or away from, the rotary member.

According to the arrangement, the cleaning member moves into contact with, or away from, the rotary member by following a predetermined path. The rotation angle of the contact and separation shaft is specified according to the press-contact motion of the pressure member. If the cleaning member is simply pivoted around the contact and separation shaft, however, the rotary member may be excessively pressed. By composing the contact and separation interlocking section of the first coupling section and the second coupling section as above, the range of motion of the cleaning member does not overlap the path that would be followed by the pivoting contact and separation shaft. Therefore, the travel distance of the cleaning member can be adjusted within a suitable range irrespective of the rotation angle of the contact and separation shaft.

The fixing device in accordance with the present invention may be arranged so as to further include: a press roller for pressing the cleaning member; and a roller biasing member for biasing the press roller in a bias direction intersecting with contact and separation directions in which the cleaning member moves into contact with, or away from, the rotary member, wherein: the cleaning member is supported to reciprocate freely in the contact and separation directions; and the press roller biases the cleaning member, separated from the rotary member, in one of the contact and separation directions in which the cleaning member moves away from the rotary member.

According to the arrangement, the reciprocating cleaning member is biased. The press roller therefore serves as a stopper that regulates the position of the cleaning member. The cleaning member is reliably separated from the rotary member, thereby preventing temperature drops in the rotary member.

The fixing device in accordance with the present invention may be arranged so that the press roller biases the cleaning member, being in contact with the rotary member, in the other one of the contact and separation directions in which the cleaning member moves into contact with the rotary member.

According to the arrangement, the cleaning member is biased toward the rotary member. The cleaning member is therefore reliably moved into contact with the rotary member. The force with which the cleaning member presses the rotary member can be adjusted to a suitable strength.

The fixing device in accordance with the present invention may be arranged so as to further include: a cleaning web stretched by an unwinding roller and a winding roller; and a press roller for pressing the cleaning member via the cleaning web.

According to the arrangement, the toner on the cleaning member is wiped out by the cleaning web. That keeps the surface of the cleaning member clean.

The fixing device in accordance with the present invention may be arranged so that when the cleaning member is located with a center thereof closer to the rotary member than to a base line in the contact and separation directions, the press roller biases the cleaning member in the other one of the contact and separation directions in which the cleaning member moves into contact with the rotary member, and when the cleaning member is located with the center thereof farther from the rotary member than from the base line in the contact and separation directions, the press roller biases the cleaning member in the one of the contact and separation directions in which the cleaning member moves away from the rotary member, the base line being a straight line parallel to the bias direction and running through a center of the press roller.

According to the arrangement, the cleaning member is biased by the press roller in different directions according to on which side of the base line the cleaning member resides. Thus, the cleaning member is located in a position that is suited to the situation.

The fixing device in accordance with the present invention may be arranged so that: the cleaning member moves between a cleaning position where the cleaning member is in contact with the rotary member and a standby position where the cleaning member is separated from the rotary member; the cleaning position is closer to the rotary member than to the base line in the contact and separation directions; and the standby position is farther from the rotary member than from the base line in the contact and separation directions.

According to the arrangement, the cleaning member and the press roller are located in the predetermined positions. Thus, the cleaning member is readily biased by the press roller in different directions according to on which side of the base line the cleaning member resides.

The fixing device in accordance with the present invention may be arranged so that the cleaning member has a rotational shaft supported, with play, by a shaft support section.

According to the arrangement, there is provided play around the shaft support section. Thus, the cleaning member readily reciprocates.

The fixing device in accordance with the present invention may be arranged so that the cleaning member is capable of freely moving into contact with, or away from, the peripheral surface of the pressure member, and moves into contact with the pressure member in conjunction with the contact and separation unit press-contacting the pressure member and moves away from the pressure member in conjunction with the contact and separation unit separating from the pressure member.

According to the arrangement, the toner that has moved from the rotary member to the pressure member is removed by moving the cleaning member into contact with the pressure member. Furthermore, frictional damage is prevented by moving the cleaning member away from the pressure member when the pressure member has stopped rotating.

The fixing device in accordance with the present invention may be arranged so that the contact and separation unit has a contact and separation shaft that can be pivoted to move the pressure member into contact with, or away from, the rotary member.

According to the arrangement, the contact and separation unit readily enables the cleaning member to operate in conjunction with the pressure member.

The fixing device in accordance with the present invention may be arranged so that either one of the unwinding roller and the winding roller is disposed substantially interposed between external common tangents of the other one of the unwinding roller and the winding roller and the press roller.

According to the arrangement, the unwinding roller and the winding roller are located close to each other. The arrangement therefore allows for a thinner cleaning unit and additional freedom in the design of the image forming apparatus.

The fixing device in accordance with the present invention may be arranged so that the cleaning web is stretched substantially parallel to a transport direction of the printing paper.

According to the arrangement, the cleaning web is stretched parallel to the transport direction of the printing paper (parallel to the direction in which the fixing device requires an extra length). The arrangement thus allows for a smaller fixing device than when the cleaning web is stretched in another direction.

The fixing device in accordance with the present invention may be arranged so that: the rotary member and/or the pressure member have a planar region that forms a plane in a part of the peripheral surface(s) thereof; and the cleaning web is stretched substantially parallel to the planar region.

According to the arrangement, the cleaning web is stretched parallel to the planar region (parallel to the direction in which the fixing device requires an extra length). The arrangement thus allows for a smaller fixing device than when the cleaning web is stretched in another direction.

The fixing device in accordance with the present invention may be arranged so that the cleaning member is a roller with an oil storage layer for storing oil.

According to the arrangement, the cleaning member has an oil storage layer. The oil reduces friction on the peripheral surface of the rotary member, enabling smooth rotation of the cleaning member. The arrangement therefore prevents the rotary member from developing scratches during cleaning. In addition, the cleaning web, distanced from the rotary member, removes the dirt and grime (e.g., toner) collected by the cleaning member. The arrangement thereby prevents the dirt and grime from moving back to the rotary member.

The fixing device in accordance with the present invention may be arranged so that: the rotary member is a fixing belt stretched by a plurality of rollers; and the cleaning member contacts a non-roller-contact region that forms a part of a peripheral surface of the fixing belt stretched by the plurality of rollers.

According to the arrangement, the cleaning member is moved into contact with a part of the backside of the fixing belt that is not in contact with the rollers. The cleaning member therefore applies a smaller load on the fixing belt. The arrangement thus prevents damage of the fixing belt. In other words, when the non-roller-contact region is pressed by the cleaning member, the fixing belt warps back. The arrangement thus prevents load from being applied locally onto the peripheral surface of the fixing belt.

An image forming apparatus in accordance with the present invention includes a fixing device in accordance with the present invention.

According to the arrangement, the image forming apparatus in accordance with the present invention includes a fixing device in accordance with the present invention. The image forming apparatus thus has the same function and effect as the fixing device in accordance with the present invention.

DESCRIPTION OF EMBODIMENTS

The following will describe image forming apparatuses in accordance with embodiments of the present invention in reference to drawings.

Figure 1:
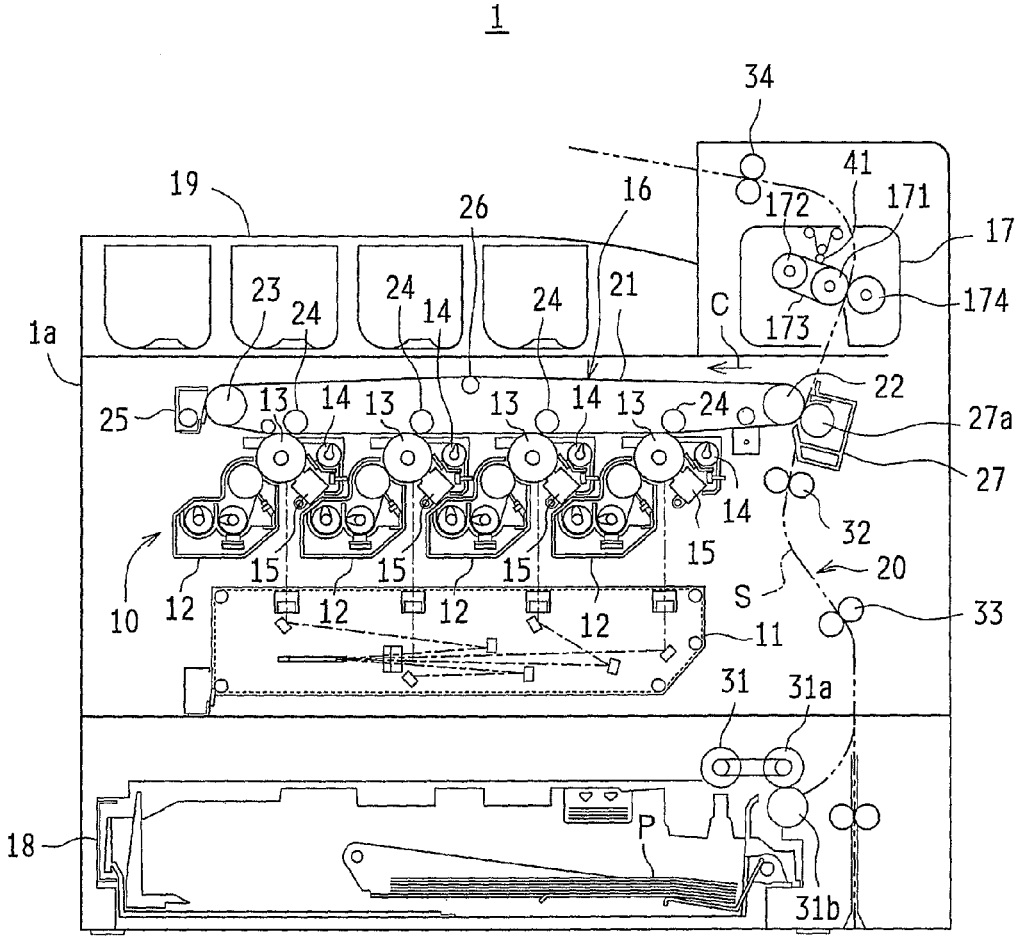
FIG. 1 is a schematic side view of the structure of an image forming apparatus in accordance with an embodiment of the present invention.

FIG. 1 is a schematic side view of the structure of an image forming apparatus in accordance with an embodiment of the present invention.

An image forming apparatus 1 includes an image forming unit 1*a* for forming multicolor and single color images on predetermined printing paper from incoming image data.

The image forming unit 1*a* includes a light exposure device 11, development devices 12, photosensitive drums 13, cleaning devices 14, charging units 15, an intermediate transfer belt device 16, a fixing device 17, a paper feed tray 18, a paper ejection tray 19, and a paper transport device 20.

The image forming apparatus is compatible with image data representing a color image composed of black (K), cyan (C), magenta (M), and yellow (Y). Correspondingly, there are provided four sets of development devices 12, photosensitive drums 13, charging units 15, and cleaning devices 14, each set being dedicated to a different color (black, cyan, magenta, and yellow), so as to form four types of latent images of different colors. The sets thus provide four image stations.

The photosensitive drums 13 are located near the center of the image forming unit 1*a* in the image forming apparatus 1. Each charging unit 15 charges the surface of an associated photosensitive drum 13 to a predetermined uniform electric potential. The light exposure device 11 shines light onto the surface of the photosensitive drum 13 to form an electrostatic latent image. The development device 12 then develops the electrostatic latent image on the surface of the photosensitive drum 13 to form a toner image on the surface of the photosensitive drum 13. A toner image of each color is formed on the surface of the photosensitive drum 13 by this sequence of actions. The cleaning device 14 removes and collects residual toner from the surface of the photosensitive drum 13 after development and image transfer.

The intermediate transfer belt device 16, located on the photosensitive drums 13, includes an intermediate transfer belt 21, an intermediate transfer belt drive roller 22, an intermediate transfer belt idler roller 23, four intermediate transfer rollers 24 (one for each Y, M, C, and K image station), an intermediate transfer belt cleaning device 25, and a tension roller 26.

The intermediate transfer belt drive roller 22, the intermediate transfer belt idler roller 23, the intermediate transfer rollers 24, and the tension roller 26 stretch the intermediate transfer belt 21 so that the surface of the intermediate transfer belt 21 can be moved in a predetermined direction (indicated by arrow C in FIG. 1).

The intermediate transfer belt 21 moves around in the direction indicated by arrow C. As the belt 21 moves around, the intermediate transfer belt cleaning device 25 removes and collects residual toner, and the toner images of the different colors formed on the surfaces of the photosensitive drums 13 are transferred and superimposed one after the other, so as to form a color toner image on the surface of the intermediate transfer belt 21.

The image forming unit 1*a* further includes a secondary transfer device 27 that in turn includes a transfer roller 27*a*. The transfer roller 27*a* forms a nip region between itself and the intermediate transfer belt 21 so that the roller 27*a* and the belt 21 can nip the printing paper P transported via a paper transport path S in the nip region for transport. The toner image on the surface of the intermediate transfer belt 21 is transferred onto the printing paper P when the paper P passes through the nip region.

The paper feed tray 18 is for storing sheets of printing paper P for use in image formation and disposed near the bottom of the light exposure device 11. The paper ejection tray 19 is disposed on top of the image forming unit 1*a* to receive sheets of printing paper P on which an image has been formed.

The paper transport device 20, provided in the image forming unit 1*a* in the image forming apparatus 1, delivers the printing paper P from the paper feed tray 18 to the paper ejection tray 19 via, for example, the secondary transfer device 27 and the fixing device 17. The paper transport device 20 includes the "S" shaped paper transport path S and also includes, along the paper transport path S, a pickup roller 31, a pair of separation rollers 31*a* and 31*b*, registration rollers 32, pre-registration rollers 33, the fixing device 17, and ejection rollers 34.

The pickup roller 31 is located near an end of the paper feed tray 18 so that it can feed printing paper P a sheet at a time from the paper feed tray 18 into the paper transport path S. One of the separation rollers, or the separation roller 31*a*, separates the sheets of printing paper P by passing the printing paper P a sheet at a time between itself and the other separation roller 31*b* to transport it to the paper transport path S. The registration rollers 32 temporarily stop the incoming printing paper P that has been transported from the paper feed tray 18 before letting it move on to the transfer roller 27*a* at such a timing that the leading end of the toner image on one of the photosensitive drums 13 can align with the leading end of the printing paper P. The pre-registration rollers 33 are small rollers that facilitate and aid the transport of the printing paper P.

The fixing device 17 is of a belt fixing type in which a fixing belt (exemplary rotary member) 173 is wound around rollers (a fixing roller 171 and a heating roller 172). The fixing belt 173 is capable of heat transfer from the heating roller 172 to the fixing roller 171. In the fixing device 17, a pressure roller (exemplary pressure member) 174 is capable of applying pressure onto the fixing roller 171 via the fixing belt 173. The fixing belt 173 has a predetermined thickness (e.g., 250 μm) and a width that is slightly larger (e.g., approximately 350 mm) than the width of the largest printing paper P (specifically, landscape A4). The "width" here refers to the dimension of the belt or paper measured perpendicular to the paper transport direction. In the fixing device 17, printing paper P on which an unfixed toner image has been formed is received and nipped between the fixing belt 173 and the pressure roller 174 for transport. After the toner image is fixed, the printing paper P is ejected by the ejection rollers 34 onto the paper ejection tray 19. The fixing device 17 will be described later in detail in reference to FIGS. 2 to 4.

The fixing device 17 is of a belt fixing type in the present embodiment. The fixing device 17 is however by no means limited to this example and may be of a type where the pressure roller 174 directly presses the fixing roller 171. When this is actually the case, the rotary member mentioned above is an equivalent of the fixing roller 171.

Next, a fixing device in accordance with a first embodiment of the present invention will be described in reference to drawings.

Figure 2:
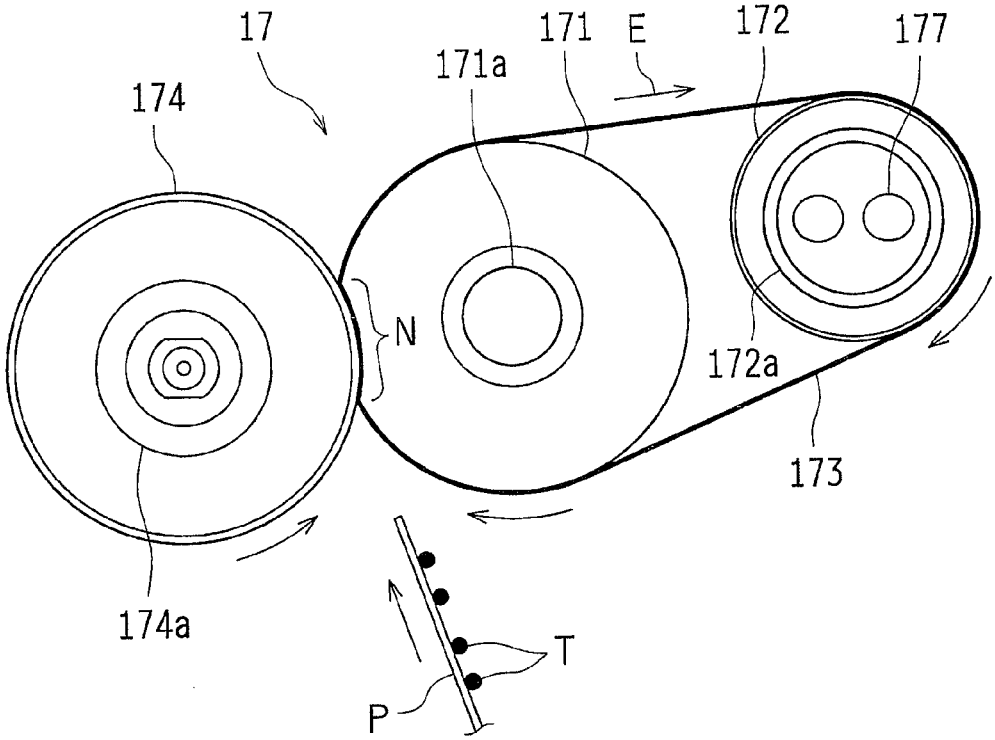
FIG. 2 is a side view of major parts of a fixing device in accordance with a first embodiment of the present invention.

FIG. 2 is a side view of major parts of a fixing device in accordance with a first embodiment of the present invention.

FIG. 2 illustrates only the fixing roller 171, the heating roller 172, the pressure roller 174, and the fixing belt 173 among the various members in the fixing device 17 shown in FIG. 1. Note that the left and right are reversed in FIG. 2 when compared with FIG. 1 because the image forming apparatus 1 is shown in FIG. 1 as viewed from the front of the image forming unit 1*a* and in FIG. 2 as viewed from the back of the image forming unit 1*a*. In addition, the contact and separation units 100, the cleaning roller 41, etc., which are shown in FIG. 3 and will be described later in detail, are omitted in FIG. 2 for the sake of clarity.

As illustrated in FIG. 2, when the fixing roller 171 and the pressure roller 174 are press-contacted to each other, a fixing nip region N is formed between the fixing belt 173 and the pressure roller 174. Each fixing device 17 includes a contact and separation unit 100 (see FIG. 3) that press-contacts the pressure roller 174 to the fixing roller 171.

Specifically, the fixing roller 171 is supported by a main body frame FL via a fixing shaft 171*a* (see FIG. 4, which will be described later in detail) of the fixing device 17 and disposed to face the unfixed toner T on the printing paper P with the fixing belt 173 being interposed therebetween. The heating roller 172 is supported by the main body frame FL via a heating shaft 172*a*. The heating shaft 172*a* contains therein a heat source 177, such as a halogen heater. The pressure roller 174 is supported by the contact and separation units 100 via a pressure shaft 174*a* (see FIG. 3) and swivels in such directions that the pressure roller 174 moves into contact with, or away from, the fixing roller 171. In the present embodiment, a driver (not shown) is connected to the fixing shaft 171*a* to rotate the fixing roller 171. With the rotation of the fixing roller 171, the fixing belt 173 moves around in the direction indicated by arrow E, and the heating roller 172 and the pressure roller 174 are also driven to rotate. The fixing shaft 171*a*, the heating shaft 172*a*, and the pressure shaft 174*a* are disposed parallel to each other.

Figure 3:
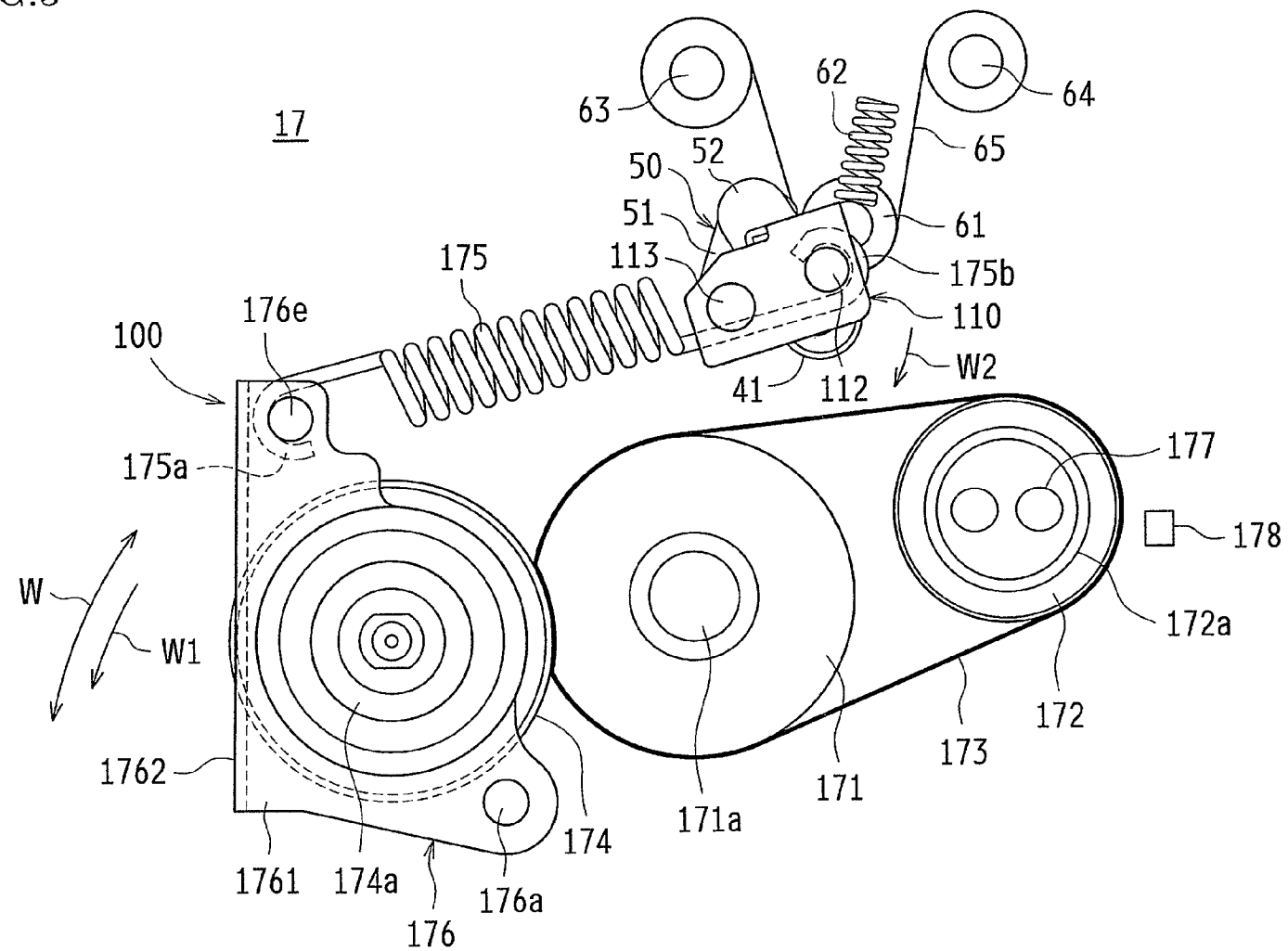
FIG. 3 is a side view of a fixing device in accordance with the first embodiment of the present invention.
Figure 4:
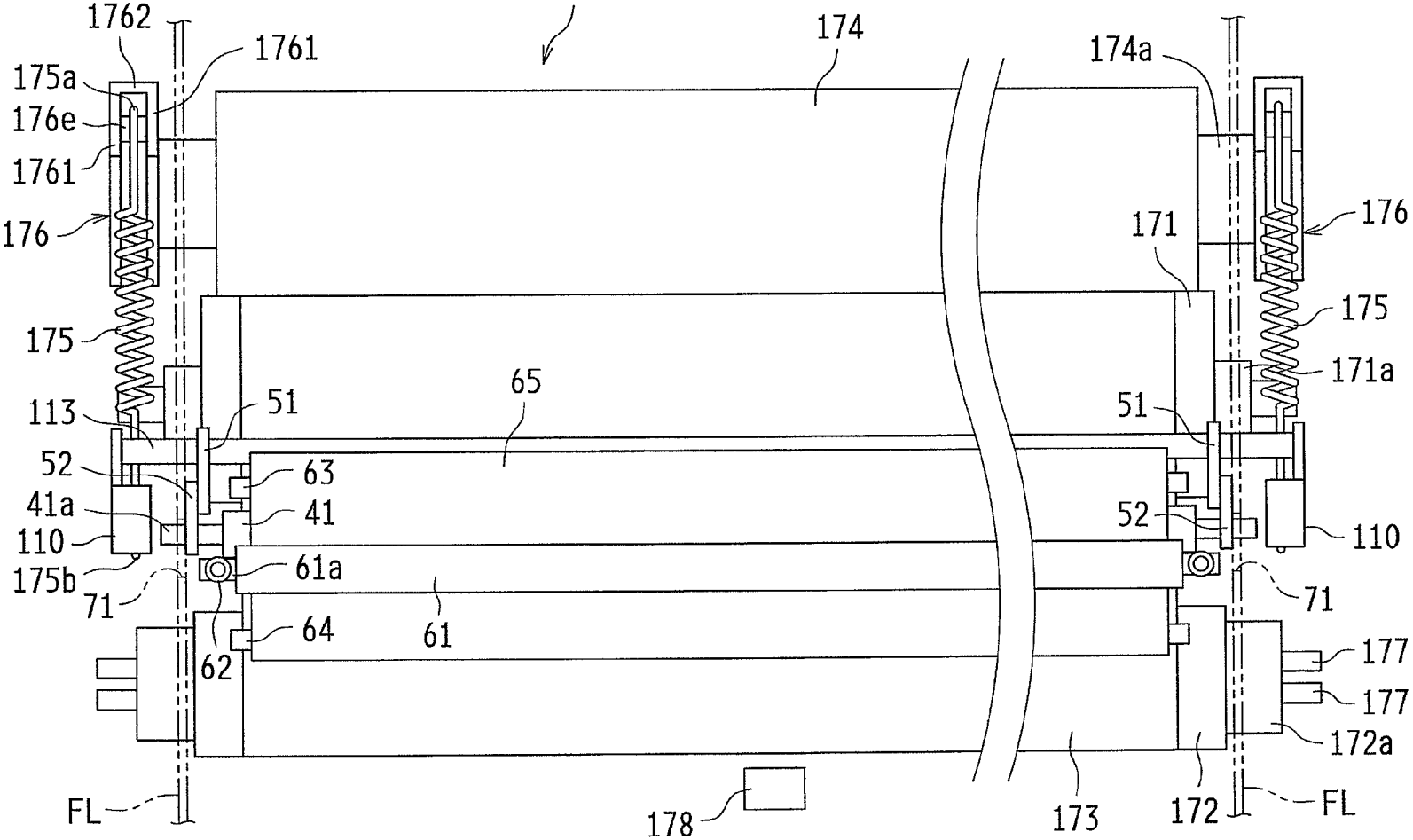
FIG. 4 is a top view of a fixing device in accordance with the first embodiment of the present invention.

FIG. 3 is a side view of a fixing device in accordance with the first embodiment of the present invention. FIG. 4 is a top view of a fixing device in accordance with the first embodiment of the present invention. For the sake of clarity, the main body frame FL is omitted in FIG. 3 and shown like a see-through view in FIG. 4. In addition, some reference numerals and symbols are omitted in FIG. 4 because the pressure frame 176 and the frame biasing section 175 disposed on the front side (on the right side in FIG. 4) has the same structure as those disposed on the backside (on the left side in FIG. 4).

Each contact and separation unit 100 is primarily composed of a pressure frame 176 supporting the pressure shaft 174*a*, a contact and separation shaft 113 pivotally connected to a driver (not shown), a pivotal member 110 pivoting in response to the pivotal motion of the contact and separation shaft 113, and a frame biasing section (e.g., coil spring) 175 press-contacting the pressure roller 174 to the fixing roller 171.

One of the pressure frames 176 is disposed on the front side of the image forming unit 1*a*, and the other on the backside. Together, the pressure frames 176 support the pressure shaft 174*a* at its ends. Each pressure frame 176 is secured to the main body frame FL via a pivotal pin 176*a* and pivots around the pivotal pin 176*a* in pressure-applying directions W. The pivotal pin 176*a* is distanced from the pressure shaft 174*a* in a direction perpendicular to the pressure shaft 174*a* (lower right to the pressure shaft 174*a* in FIG. 3). In response to the pivotal motion of the pressure frames 176, the pressure roller 174 swivels in such directions that the pressure roller 174 moves into contact with, or away from, the fixing roller 171 (fixing belt 173).

Specifically, each pressure frame 176 has a pair of support plates 1761 extending perpendicular to the pressure shaft 174*a* and a coupling plate 1762 that couples the pair of support plates 1761 together at their ends opposite from the fixing roller 171. The pivotal pin 176*a* is inserted into holes formed in the support plates 1761. Each support plate 1761 has a latching boss 176*e* on the opposite side of the pressure shaft 174*a* from the pivotal pin 176*a* (upper left to the pressure shaft 174*a* in FIG. 3). The frame biasing sections 175 are latched at their frame-end latch sections 175*a* by the latching bosses 176*e*.

The contact and separation shaft 113 is disposed parallel to the pressure shaft 174*a* and downstream of the fixing nip region N (above the fixing belt 173 in FIG. 3) and supported by the main body frame FL. One of the pivotal members 110 is disposed on the front side, and the other on the backside. The pivotal members 110 are secured to the ends of the contact and separation shaft 113. Each pivotal member 110 has a pivotal boss 112. The frame biasing sections 175 are latched at their pivot-end latch sections 175*b* by the pivotal bosses 112. The pivotal members 110 pivot around the contact and separation shaft 113. The pivotal bosses 112 move around the contact and separation shaft 113.

Near the fixing belt 173 is there provided a thermistor 178 sensing the temperature of the fixing belt 173. Specifically, the thermistor 178 is disposed to face the heating roller 172 with the fixing belt 173 being interposed therebetween. Its position is however by no means limited; the thermistor 178 may be disposed anywhere else around the fixing belt 173.

The fixing device 17 further includes: a cleaning roller 41 (exemplary cleaning member) facing the peripheral surface of the fixing belt 173; contact and separation interlocking sections 50 supporting the cleaning roller 41; an unwinding roller 63 and a winding roller 64 rotating in synchronism with each other; a cleaning web 65 stretched by the unwinding roller 63 and the winding roller 64; and a press roller 61 pressing the cleaning roller 41 via the cleaning web 65. Throughout the following description, the cleaning roller 41, the contact and separation interlocking sections 50, the unwinding roller 63, the winding roller 64, the cleaning web 65, and the press roller 61 may be collectively referred to as the cleaning mechanism for convenience. The cleaning mechanism is disposed downstream of the fixing nip region N.

The cleaning roller 41, at the ends of the rotational shaft 41*a*, is inserted in regulation holes 71 formed in the main body frame FL. The rotational shaft 41*a* is disposed parallel to the contact and separation shaft 113 and reciprocally movable in such contact and separation directions X (see FIG. 6A; details will be given later) that the rotational shaft 41*a* moves closer to, or away from, the fixing belt 173. In the present embodiment, the cleaning roller 41 is made from an aluminum pipe; alternatively, the cleaning roller 41 may have, for example, a built-in heating pipe. The cleaning member in the present invention is by no means limited to the cleaning roller 41 and may be of any other type so long as the cleaning roller 41 can efficiently collect toner T from the fixing belt 173.

As shown in, for example, FIG. 3 and FIG. 6A (which will be detailed later), each contact and separation interlocking section 50 is composed of a first coupling section 51 and a second coupling section 52. The first coupling section 51 is secured at an end thereof to the contact and separation shaft 113. The second coupling section 52 is connected at an end thereof to the first coupling section 51 and at the other end supports the rotational shaft 41*a* at an end thereof. One of the contact and separation interlocking sections 50 is disposed on the front side, and the other on the backside.

The cleaning web 65 is a sheet of, for example, nylon fiber or polyester fiber. The cleaning web 65 has an end thereof wound around the unwinding roller 63 and the other end wound around the winding roller 64. The press rollers 61 press, toward the cleaning roller 41, the cleaning web 65 stretched by the unwinding roller 63 and the winding roller 64. More specifically, as shown in, for example, FIG. 4 and FIG. 6A (which will be detailed later), the press rollers 61 have roller biasing members 62 at the ends of a press shaft 61*a* and are biased by the roller biasing members 62 in such a bias direction Y (see FIG. 6A) that the press rollers 61 press the cleaning roller 41 via the cleaning web 65.

The structure of the cleaning mechanism will be described in detail in reference to FIGS. 6A to 6C (which will be described later).

As mentioned earlier, the pressure frames 176 press-contact the pressure roller 174 to the fixing roller 171 by means of the biasing force of the frame biasing sections 175. Therefore, as the pivotal members 110 are pivoted around the contact and separation shaft 113 in the direction indicated by arrow W2 in FIG. 3, the pivot-end latch sections 175*b* latching the frame biasing sections 175 move. That in turn changes the biasing forces of the frame biasing sections 175. As a result, the pressure roller 174 swivels in such a direction indicated by arrow W1 (one of pressure-applying directions W) that the pressure roller 174 moves away from the fixing roller 171. In the fixing device 17, the position of the pressure roller 174 relative to the fixing roller 171 can be suitably adjusted where necessary by adjusting the angle the pivotal members 110 pivot. In the present embodiment, the pressure roller 174 is set up to occupy one of three positions: a press-contact position where the pressure roller 174 press-contacts the fixing roller 171, a press-melt position where the pressure roller 174 press-contacts the fixing roller 171 with a weaker force than when it is in the press-contact position, and a distanced position where the pressure roller 174 is separated from the fixing roller 171. For convenience, the fixing device 17 will be depicted as being in "press-contact mode" when the pressure roller 174 is in the press-contact position, "press-melt mode" when the pressure roller 174 is in the press-melt position, and "cleaning mode" when the pressure roller 174 is in the distanced position throughout the following description.

Next, the press-contact motion of the pressure roller 174 with respect to the fixing roller 171 will be described in reference to drawings.

Figure 5A:
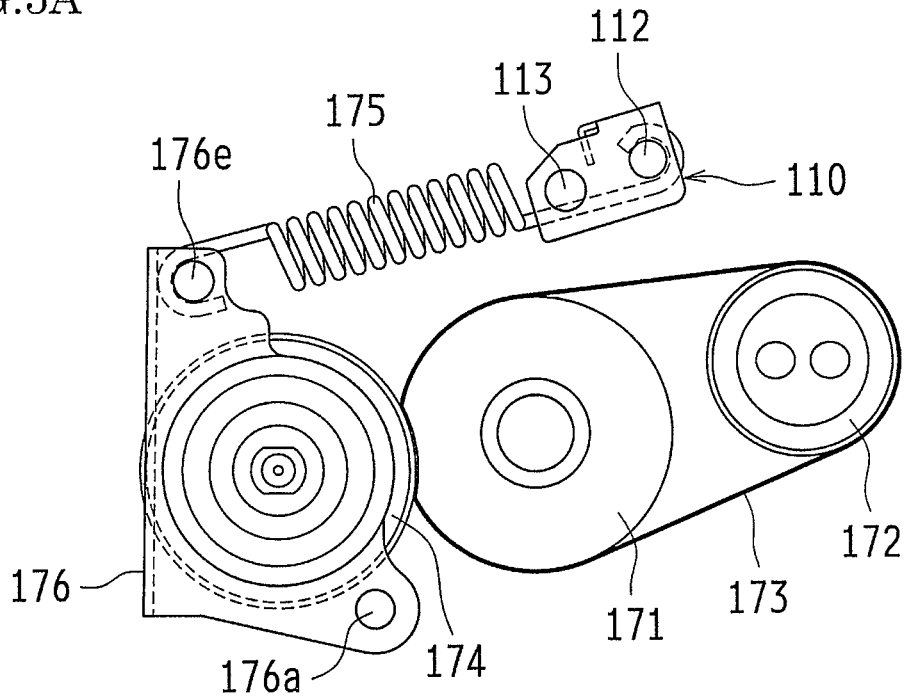
FIG. 5A is a diagram showing a contact and separation unit in a fixing device in accordance with the first embodiment of the present invention in press-contact mode.

FIG. 5A is a diagram showing a contact and separation unit in a fixing device in accordance with the first embodiment of the present invention in press-contact mode. FIG. 5A does not show the cleaning mechanism shown in FIG. 3 for the sake of clarity.

Similarly to FIGS. 2 and 3, FIG. 5A shows a condition where the pressure roller 174 is in the press-contact position, being biased by the frame biasing sections 175 to press the fixing roller 171 (fixing belt 173). In press-contact mode, an unfixed toner image is fixed on printing paper P by nipping the printing paper P between the fixing belt 173 and the pressure roller 174 and applying pressure and heat to the paper P.

Figure 5B:
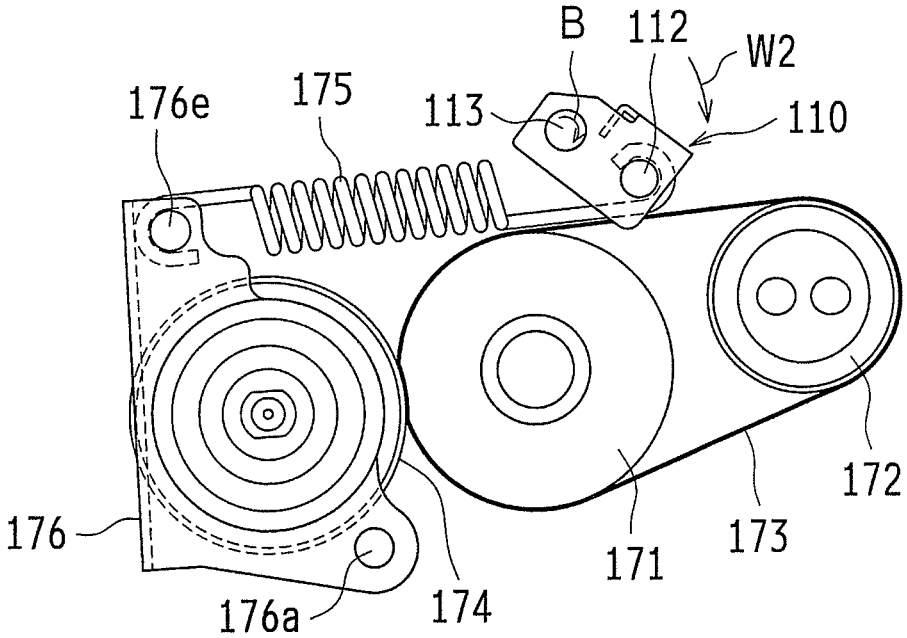
FIG. 5B is a diagram showing a contact and separation unit in a fixing device in accordance with the first embodiment of the present invention in press-melt mode.

FIG. 5B is a diagram showing a contact and separation unit in a fixing device in accordance with the first embodiment of the present invention in press-melt mode.

FIG. 5B shows the contact and separation shaft 113 which, starting from the condition shown in FIG. 5A, has rotated in the direction indicated by arrow B (i.e., the pivotal members 110 have rotated in the direction indicated by arrow W2) and stopped. As a result of the rotation of the contact and separation shaft 113, the pressure roller 174 is in the press-melt position where the pressure roller 174 is more distanced from the fixing roller 171 than it is in the press-contact position. The pressure roller 174 is in contact with the fixing belt 173. In press-melt mode, an unfixed toner image can be fixed on an envelope, postcard, or like thick sheet of printing paper P without causing a transport error because the printing paper P is nipped by a weaker force in press-melt mode than in press-contact mode.

Figure 5C:
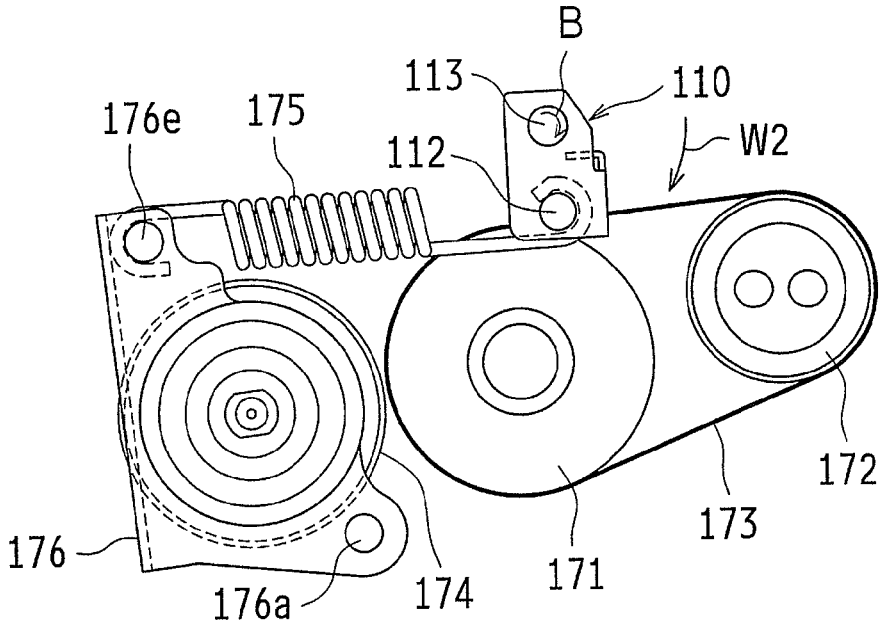
FIG. 5C is a diagram showing a contact and separation unit in a fixing device in accordance with the first embodiment of the present invention in cleaning mode.

FIG. 5C is a diagram showing a contact and separation unit in a fixing device in accordance with the first embodiment of the present invention in cleaning mode.

FIG. 5C shows the contact and separation shaft 113 which, starting from the condition shown in FIG. 5B, has further rotated in the direction indicated by arrow B (i.e., the pivotal members 110 have rotated in the direction indicated by arrow W2) and stopped. The pressure roller 174 is in the distanced position, separated by a distance from the fixing roller 171. In cleaning mode, the pressure roller 174 is separated from the fixing roller 171. Therefore, even if the fixing belt 173 is rotated, the pressure roller 174 does not rotate, and the residual toner and other unwanted material on the surface of the fixing belt 173 do not stick to the pressure roller 174.

As illustrated in FIGS. 5A to 5C, in the contact and separation units 100, the contact and separation shaft 113 is rotated to move the pressure roller 174 into contact with, or away from, the fixing belt 173. Besides, in the present embodiment, the cleaning roller 41 also moves in conjunction with the oscillating of the contact and separation units 100. In other words, the cleaning roller 41 moves into contact with, or away from, the fixing belt 173 in conjunction with the contact and separation units 100 moving the pressure roller 174 into contact with, or away from, the fixing belt 173. In other words, the position of the pressure roller 174 dictates the position of the cleaning roller 41 relative to the fixing belt 173. Accordingly, the movement and positions of the cleaning roller 41 as dictated by the condition of the contact and separation units 100 will be described next in reference to drawings.

Figure 6A:
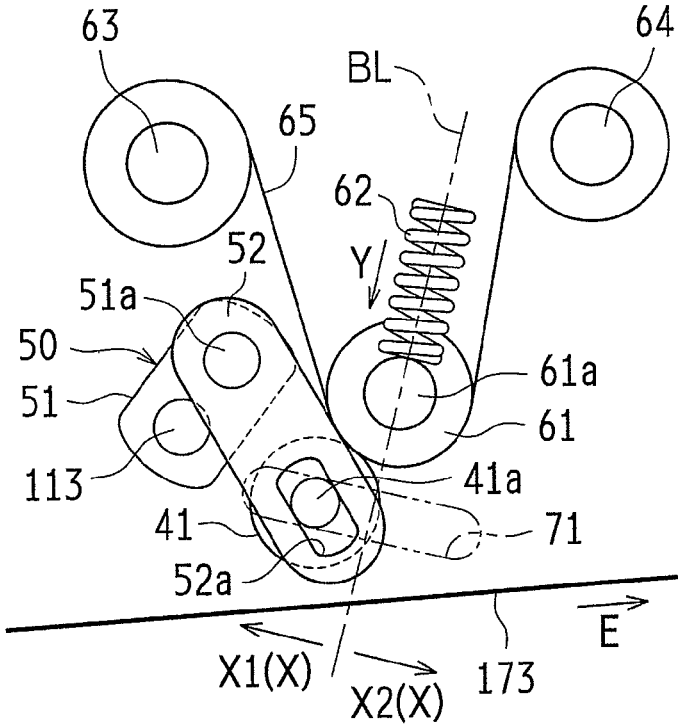
FIG. 6A is a diagram showing a cleaning mechanism in a fixing device in accordance with the first embodiment of the present invention in press-contact mode.

FIG. 6A is a diagram showing a cleaning mechanism in a fixing device in accordance with the first embodiment of the present invention in press-contact mode. In FIG. 6A, the contact and separation units 100, which are shown in FIG. 3, are omitted, and the main body frame FL is shown like a see-through view for the sake of clarity.

Similarly to FIG. 5A, FIG. 6A shows a condition where the pressure roller 174 is in the press-contact position. When the pressure roller 174 is in the press-contact position, the cleaning roller 41 is in a standby position that is located at a distance from the fixing belt 173.

As mentioned earlier, the rotational shaft 41*a* of the cleaning roller 41 has its ends inserted in the regulation holes 71 formed in the main body frame FL. The regulation holes 71 are openings extending in contact and separation directions X which intersect with bias direction Y. The cleaning roller 41 is thus movable in the regulation holes 71, and its range of motion is regulated by the regulation holes 71. Throughout the following description, for convenience, one of contact and separation directions X in which the rotational shaft 41*a* moves away from the fixing belt 173 will be referred to as separation direction X1, whereas the other one of contact and separation directions X in which the rotational shaft 41*a* moves closer to the fixing belt 173 will be referred to as contact direction X2.

The first coupling section 51 and the second coupling section 52 are shaped like a flat plate and extended in predetermined directions so that the sections 51 and 52 can be coupled to other members at the ends of the extensions. The first coupling section 51 and the second coupling section 52 are disposed side by side along the shaft of the contact and separation shaft 113 (see FIG. 4 for more detail). Specifically, the first coupling section 51 is secured at an end thereof to the contact and separation shaft 113 so as to be rotatable around the shaft of the contact and separation shaft 113 in conjunction with the contact and separation shaft 113. At the other end of the first coupling section 51, a coupling boss 51*a* is provided on a surface opposite the second coupling section 52. The coupling boss 51*a* is circular and protrudes toward the second coupling section 52. The second coupling section 52 has at an end thereof a hole of the same shape as the coupling boss 51*a*. The coupling boss 51*a* is inserted through this hole to lock the first coupling section 51 and the second coupling section 52. Therefore, the second coupling section 52 rotates around the coupling boss 51*a*, and if the first coupling section 51 rotates, is pulled by the first coupling section 51. The second coupling section 52 has at the other end thereof a reciprocation hole 52*a* in which the rotational shaft 41*a* is inserted. The reciprocation hole 52*a* is formed wider than the rotational shaft 41*a* in the direction in which the second coupling section 52 is extended. In other words, the rotational shaft 41*a* can reciprocation within the range allowed by the reciprocation hole 52*a*.

Base line BL shown in FIG. 6A is a straight line parallel to bias direction Y and runs through the center of the press roller 61 (press shaft 61*a*). In press-contact mode, the cleaning roller 41 (rotational shaft 41*a*) is on the X1-side of base line BL (left-hand side in FIG. 6A). In this condition, the cleaning roller 41 is in contact with the X1-side of the press roller 61, thereby being biased in separation direction X1 by the press roller 61. The cleaning roller 41 reciprocates within the range allowed by the regulation holes 71 and the reciprocation hole 52*a* and stops moving where its own weight, the biasing force of the press roller 61, etc. become balanced. As mentioned earlier, the position of the cleaning roller 41 where it stops is referred to as the standby position.

Figure 6B:
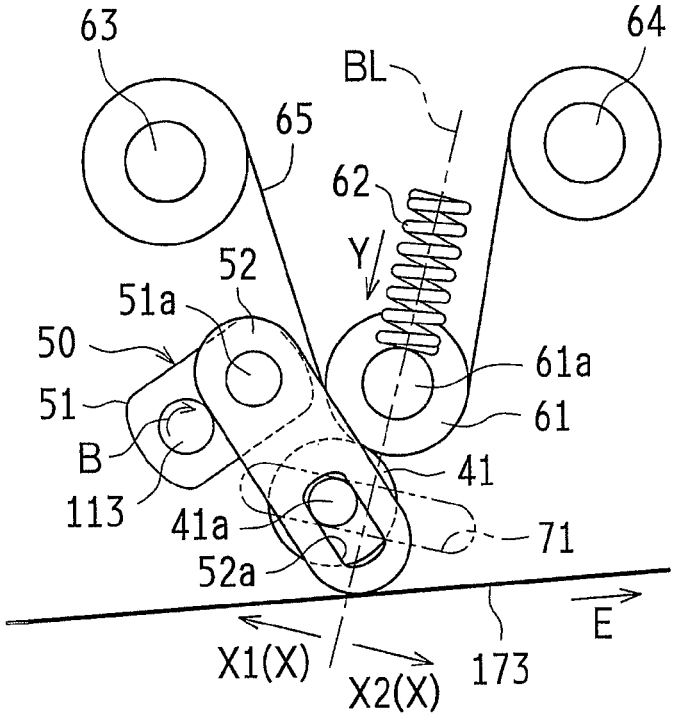
FIG. 6B is a diagram showing a cleaning mechanism in a fixing device in accordance with the first embodiment of the present invention in press-melt mode.

FIG. 6B is a diagram showing a cleaning mechanism in a fixing device in accordance with the first embodiment of the present invention in press-melt mode.

Similarly to FIG. 5B, FIG. 6B shows a condition where the pressure roller 174 is in the press-melt position, that is, where the contact and separation shaft 113, starting from the condition shown in FIG. 6A, has rotated in the direction indicated by arrow B and stopped. The first coupling section 51 has also rotated with the contact and separation shaft in the direction indicated by arrow B and stopped. The second coupling section 52 is pulled by the first coupling section 51, biasing the cleaning roller 41 (rotational shaft 41*a*) in contact direction X2. In this condition, similarly to FIG. 6A, the cleaning roller 41 is on the X1-side of base line BL (left-hand side in FIG. 6B) and therefore is in contact with the X1-side of the press roller 61, thereby being biased in separation direction X1 by the press roller 61. As a result, the cleaning roller 41 stops where the biasing forces of the second coupling section 52 and the press roller 61 become balanced. The cleaning roller 41 is thus distanced from the fixing belt 173.

Figure 6C:
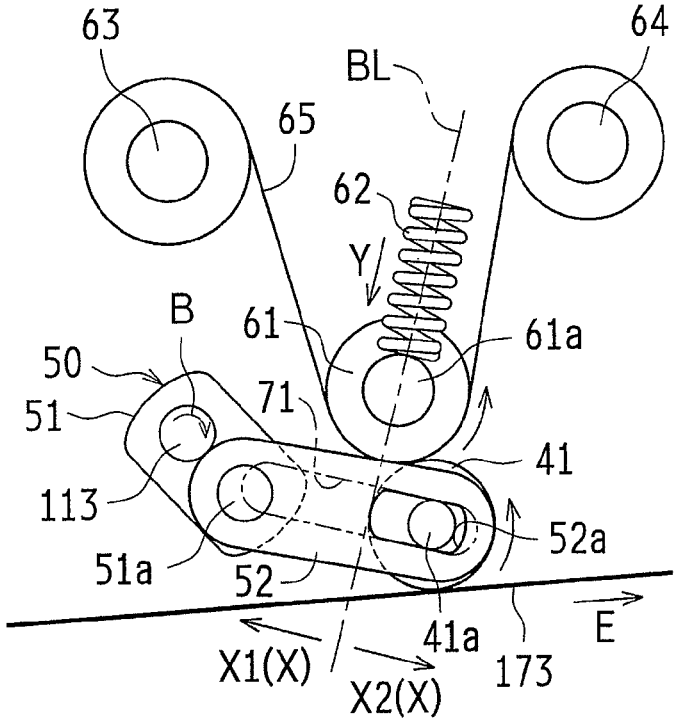
FIG. 6C is a diagram showing a cleaning mechanism in a fixing device in accordance with the first embodiment of the present invention in cleaning mode.

FIG. 6C is a diagram showing a cleaning mechanism in a fixing device in accordance with the first embodiment of the present invention in cleaning mode.

Similarly to FIG. 5C, FIG. 6C shows a condition where the pressure roller 174 is in the distanced position, that is, where the contact and separation shaft 113 and the first coupling section 51, starting from the condition shown in FIG. 6B, have further rotated in the direction indicated by arrow B and stopped. The second coupling section 52 is pulled by the first coupling section 51, biasing the cleaning roller 41 (rotational shaft 41*a*) in contact direction X2. In this condition, the cleaning roller 41, having moved in contact direction X2, is on the X2-side of base line BL (right-hand side in FIG. 6C) and therefore is in contact with the X2-side of the press roller 61, thereby being biased in contact direction X2 by the press roller 61. In short, the cleaning roller 41 is now being biased in a different direction by the press roller 61 because the cleaning roller 41 is in contact with a different part of the press roller 61. In FIG. 6C, the cleaning roller 41 is in contact with the fixing belt 173 where the force applied by the fixing belt 173 to the cleaning roller 41 is balanced with the biasing forces of the second coupling section 52 and the press roller 61.

The cleaning roller 41 contacts a part of the fixing belt 173 stretched between the fixing roller 171 and the heating roller 172 downstream of the fixing nip region N. Since the cleaning roller 41 is moved into contact with a part of the fixing belt 173 that is not in contact with the fixing roller 171 and the heating roller 172, the cleaning roller 41 does not press the fixing roller 171 or the heating roller 172. This structure reduces the load applied to the fixing roller 171 and the heating roller 172.

The cleaning roller 41 rotates on the cleaning web 65 as it moves in contact direction X2. During this rotation, if the cleaning roller 41 is also in contact with the fixing belt 173, the cleaning roller 41 rotates with the fixing belt 173 and collects toner T on the surface of the fixing belt 173. The cleaning web 65 is wound in a direction opposite the rotation of the cleaning roller 41. In other words, the cleaning web 65 is moved in such a direction that friction can develop between the cleaning web 65 and the cleaning roller 41. The friction enables the cleaning web 65 to unfailingly collect the toner T on the cleaning roller 41.

As mentioned earlier, the cleaning roller 41 moves in conjunction with the contact and separation units 100. For example, to switch from the cleaning mode shown in FIGS. 5C and 6C to the press-contact mode shown in FIGS. 5A and 6A, the cleaning roller 41 is moved from the cleaning position to the standby position by rotating the contact and separation shaft 113 in a direction opposite arrow B. To move the cleaning roller 41 in separation direction X1, the cleaning roller 41 is in contact with the cleaning web 65 and rotates on the cleaning web 65 as is the case when the cleaning roller 41 is moved in contact direction X2. Thus, the cleaning roller 41 separates from the fixing belt 173 in conjunction with the contact and separation units 100 press-contacting the pressure roller 174 and moves into contact with the fixing belt 173 in conjunction with the contact and separation units 100 separating from the pressure roller 174.

The cleaning roller 41 is biased by the press roller 61 in different directions depending on whether the cleaning roller 41 is on the X1- or X2-side of base line BL. If the cleaning roller 41 is located with its center closer to the fixing belt 173 than close to base line BL, the cleaning roller 41 is biased in contact direction X2; if the cleaning roller 41 is located with its center farther from the fixing belt 173 than from base line BL, the cleaning roller 41 is biased in separation direction X1.

In this specification, the reciprocation hole 52*a* and the regulation holes 71 are collectively referred to as a shaft support section, and the shaft support section has play around the rotational shaft 41*a*.

FIG. 3 mentioned above shows the unwinding roller 63 and the winding roller 64 being separated from each other. Alternatively, the fixing device 17 may include a cleaning unit 80 in which the unwinding roller 63 and the winding roller 64 are located close to each other. Next, the cleaning unit 80 will be described in reference to drawings.

Figure 7:
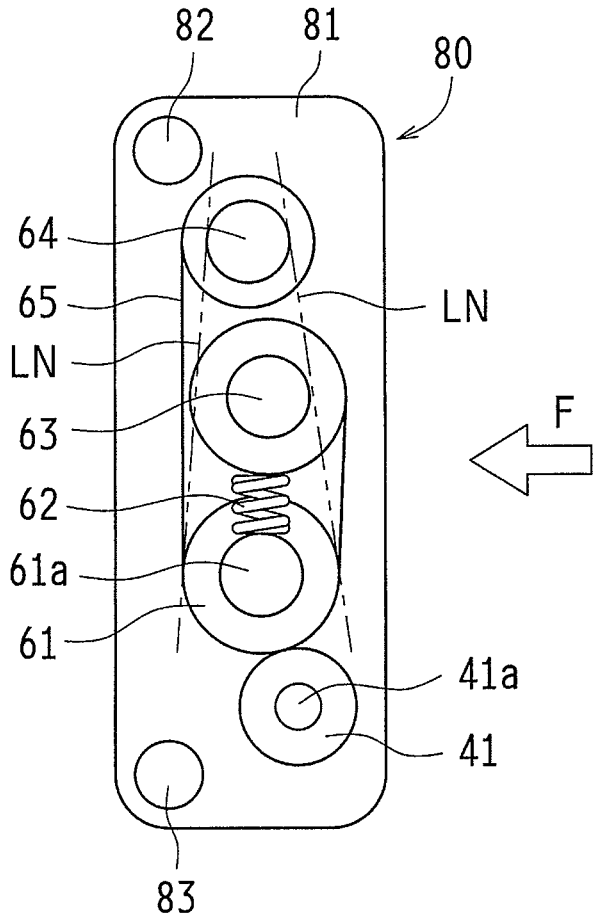
FIG. 7 is a side view of a cleaning unit in a fixing device in accordance with second to fourth embodiments of the present invention.
Figure 8:
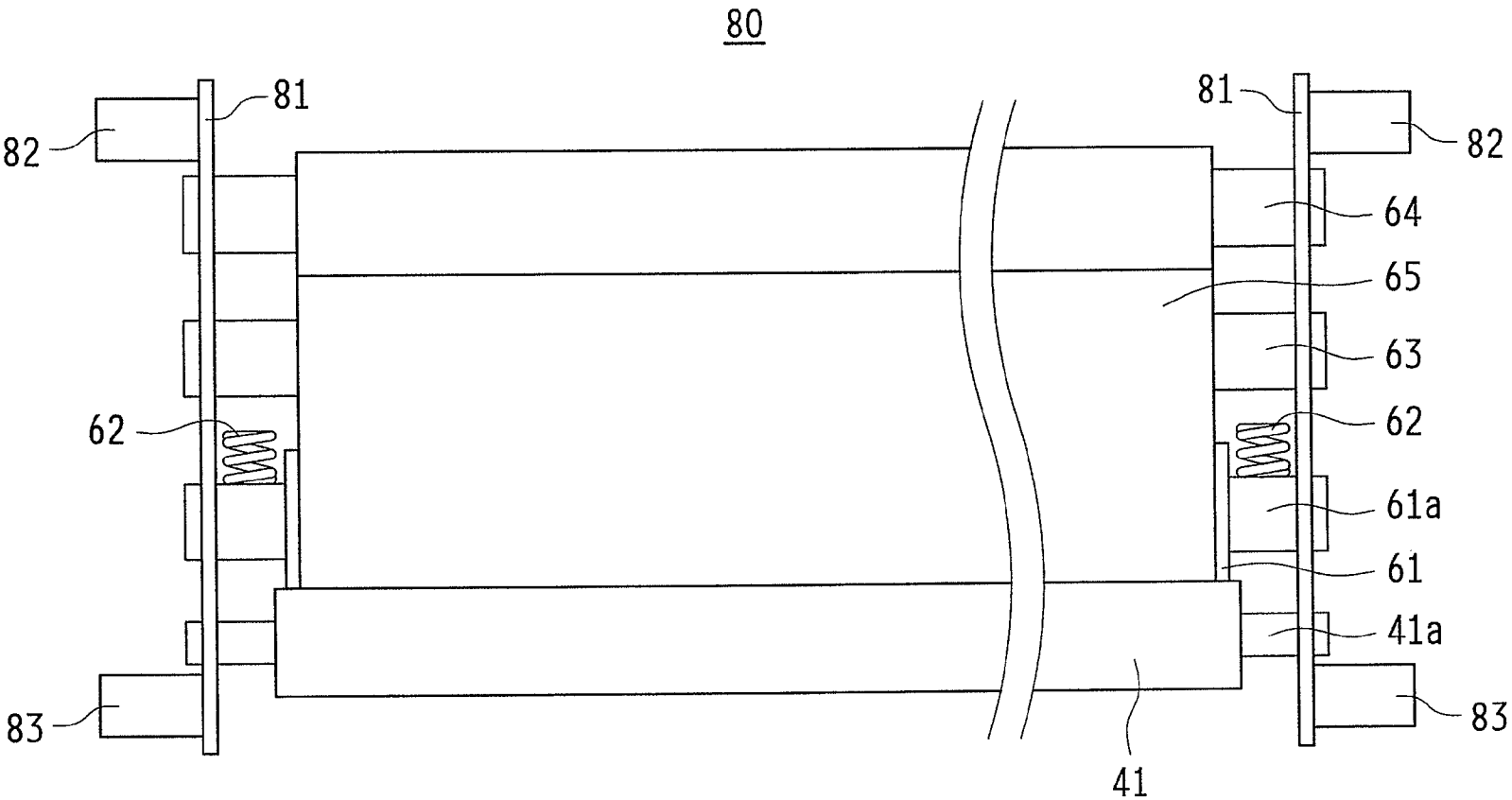
FIG. 8 is a schematic diagram showing a cleaning unit as viewed from the direction indicated by arrow F in FIG. 7.

FIG. 7 is a side view of a cleaning unit in a fixing device in accordance with second to fourth embodiments of the present invention. FIG. 8 is a schematic diagram showing a cleaning unit as viewed from the direction indicated by arrow F in FIG.

7. FIG. 7 shows one of cleaning frames 81 in front like in a see-through view for the sake of clarity. In addition, the members that essentially have the same function as those of the cleaning mechanism described above are indicated by the same reference numerals and symbols and description thereof is omitted.

The cleaning unit 80 includes a cleaning roller 41, a press roller 61, roller biasing members 62, an unwinding roller 63, a winding roller 64, a cleaning web 65, cleaning frames 81, unit securing shafts 82, and unit swiveling shafts 83. One of the cleaning frames 81 is disposed on the front side of the image forming unit 1*a*, and the other on the backside. Together, the cleaning frames 81 support at their ends the cleaning roller 41 (rotational shaft 41*a*), the press roller 61 (press shaft 61*a*), the unwinding roller 63, and the winding roller 64. The cleaning frames 81 may have play in supporting the rotational shaft 41*a* and the press shaft 61*a* so that the pressing force on, for example, the fixing belt 173 can be adjusted by reciprocating the cleaning roller 41. The unit securing shafts 82 and the unit swiveling shafts 83 are disposed to extend from the two cleaning frames 81 parallel to the shaft of the rotational shaft 41*a*. The unit securing shafts 82 are disposed at the upper ends of the cleaning frames 81 (upper left in FIG. 7) and supported by a housing (e.g., main body frame FL) in such a manner that the unit securing shafts 82 can swivel freely. The cleaning unit 80 can thus rotate around the unit securing shafts 82. The unit swiveling shafts 83 are disposed at the lower ends of the cleaning frames 81 (lower left in FIG. 7).

As mentioned earlier, the unwinding roller 63 and the winding roller 64 are disposed close to each other. Specifically, the winding roller 64, the unwinding roller 63, and the press roller 61 are disposed in this sequence from the upper to the lower portion of the cleaning frames 81. The unwinding roller 63 is disposed substantially interposed between the external common tangents LN of the winding roller 64 and the press roller 61. Closely locating the unwinding roller 63 and the winding roller 64 in this manner allows for a thinner cleaning unit and additional freedom in the design of the image forming apparatus. The unwinding roller 63 is shown below the winding roller 64 in FIG. 7; alternatively, the unwinding roller 63 and the winding roller 64 may be transposed.

Next, a fixing device 17 in accordance with the second to fourth embodiments of the present invention, incorporating the cleaning unit, will be described in reference to drawings.

Figure 9A:
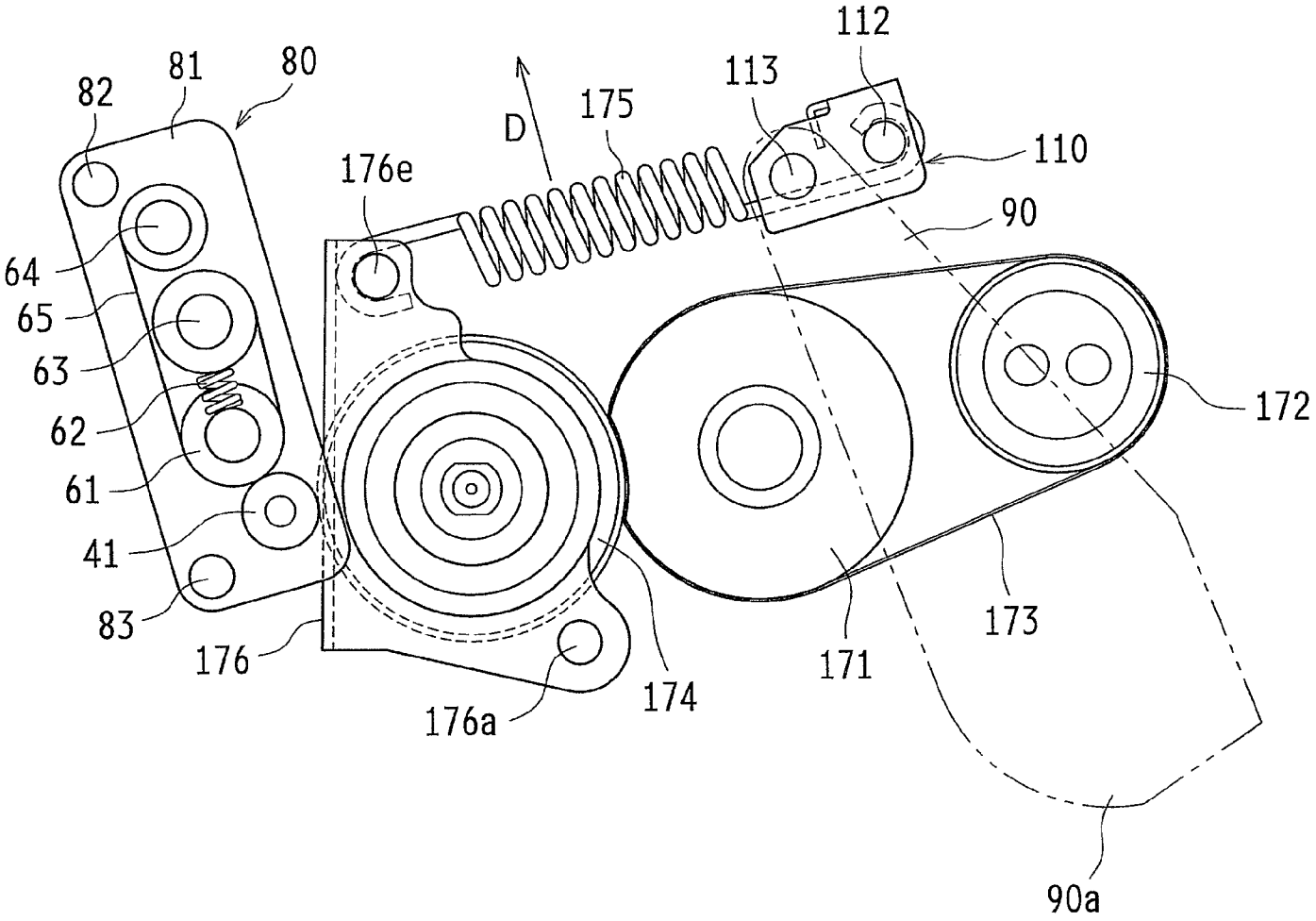
FIG. 9A is a side view of a fixing device in accordance with the second embodiment of the present invention in press-contact mode.
Figure 9B:
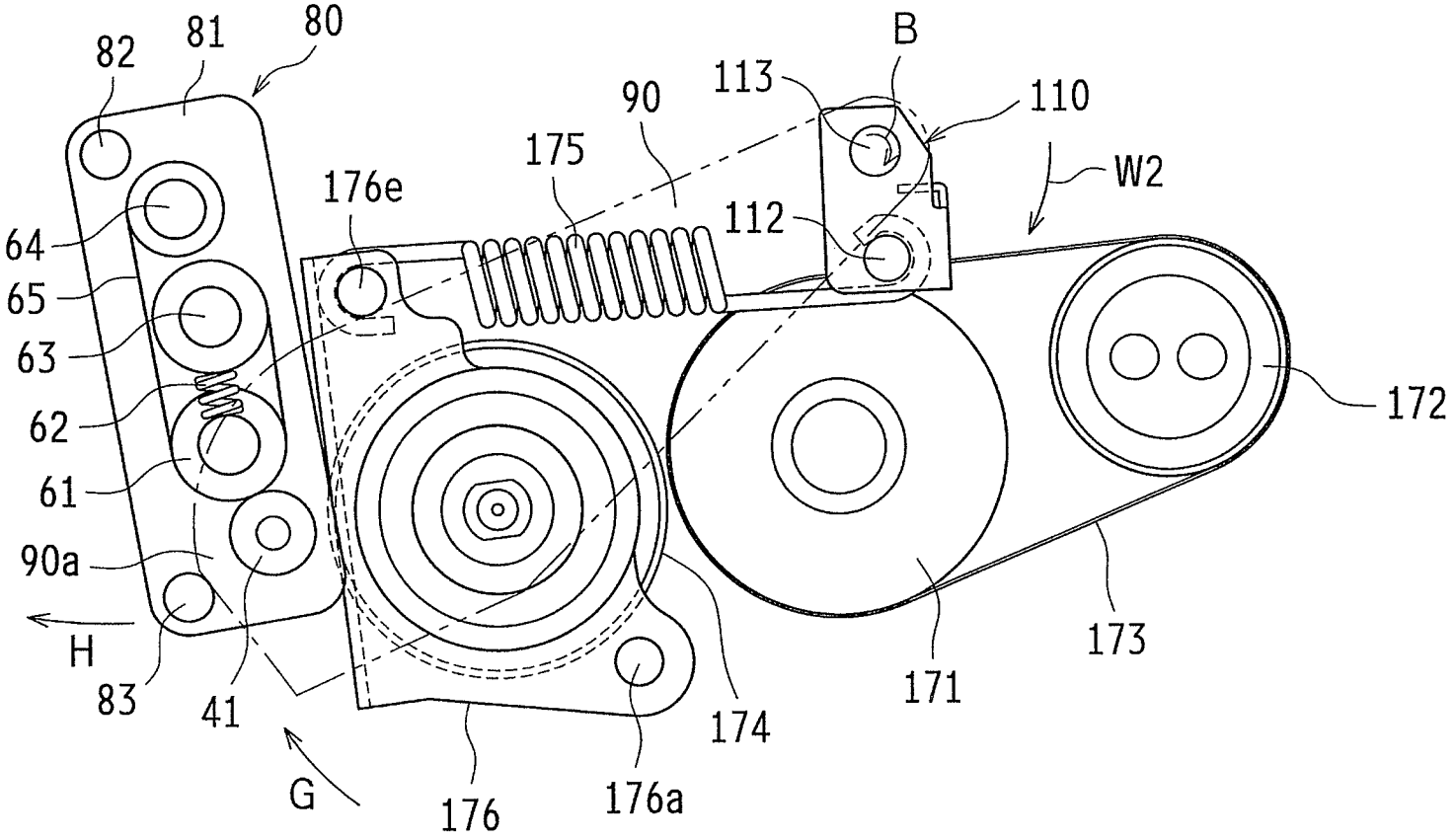
FIG. 9B is a side view of a fixing device in accordance with the second embodiment of the present invention in cleaning mode.
Figure 10:
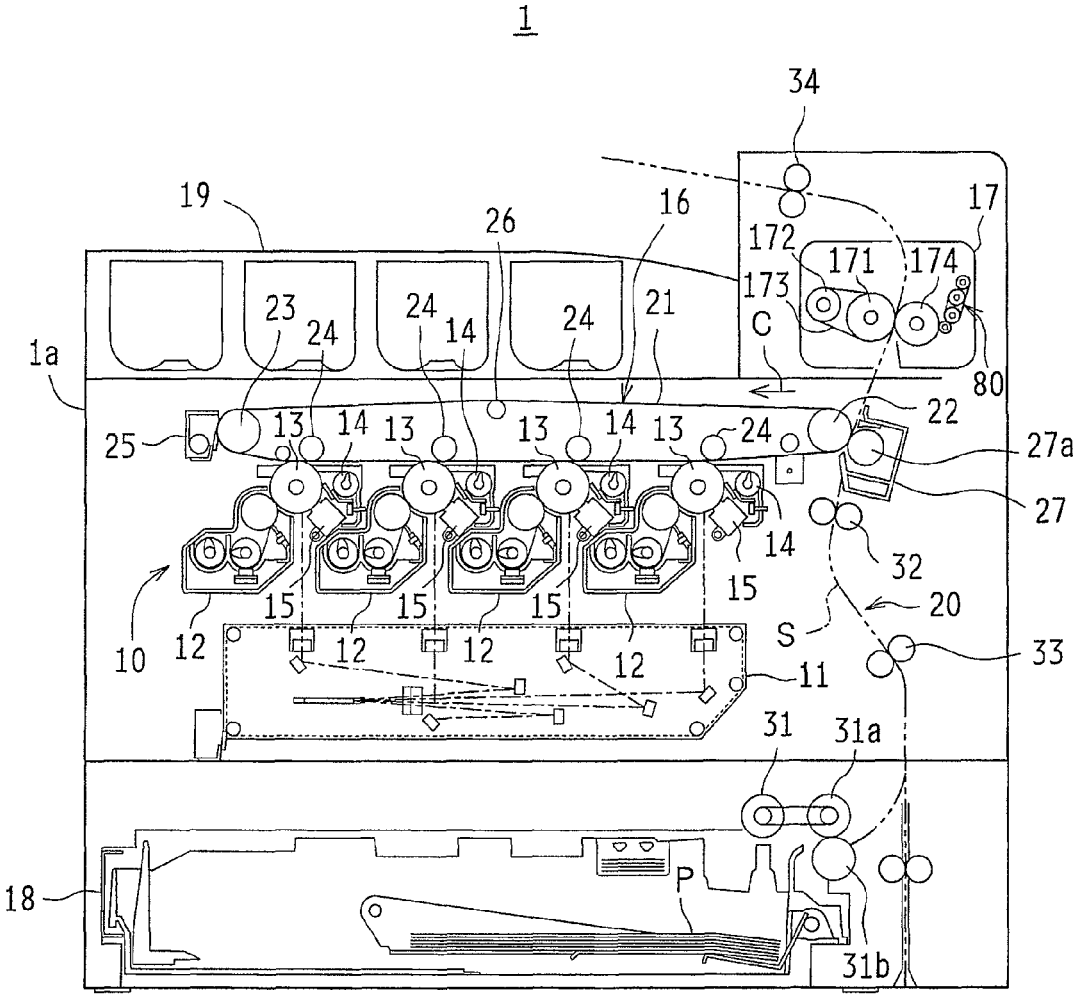
FIG. 10 is a schematic side view of the structure of an image forming apparatus incorporating a fixing device in accordance with the second embodiment of the present invention.

FIG. 9A is a side view of a fixing device in accordance with the second embodiment of the present invention in press-contact mode. FIG. 9B is a side view of a fixing device in accordance with the second embodiment of the present invention in cleaning mode. FIG. 10 is a schematic side view of the structure of an image forming apparatus incorporating a fixing device in accordance with the second embodiment of the present invention. For the sake of clarity, the main body frame FL is omitted, and contact and separation interlocking cams 90 are shown like a see-through view in FIGS. 9A and 9B. In addition, the members that essentially have the same function and structure as those in the first embodiment are indicated by the same reference numerals and symbols, and description thereof is omitted.

The second embodiment differs from the first embodiment in that the cleaning roller 41 moves into contact with, or away from, the pressure roller 174. Specifically, the cleaning roller 41 is disposed to face the peripheral surface of the pressure roller 174 (to the left of the pressure roller 174 in FIG. 9A). The cleaning web 65 is stretched substantially parallel to transport direction D for printing paper. Stretching the cleaning web 65 parallel to transport direction D for printing paper (parallel to the direction in which the fixing device 17 requires an extra length) in this manner allows for a smaller fixing device 17 than when the cleaning web 65 is stretched in another direction.

In the second embodiment, contact and separation interlocking cams 90 are included in place of the contact and separation interlocking sections 50, to move the cleaning roller 41 into contact with, or away from, the pressure roller 174. Each contact and separation interlocking cam 90 is secured at an end thereof to the contact and separation shaft 113, and at the other end has an arc-shaped cam section 90*a*. The cleaning unit 80 is biased toward the pressure roller 174 by, for example, a spring.

As illustrated in FIG. 9A, in press-contact mode, the cleaning roller 41 is in contact with the pressure roller 174 and therefore rotated by the pressure roller 174 to collect the toner T on the surface of the pressure roller 174. The contact and separation interlocking cam 90 is separated from the cleaning unit 80.

In cleaning mode shown in FIG. 9B, the contact and separation shaft 113, starting from the condition shown in FIG. 9A, has rotated in the direction indicated by arrow B and stopped. The pressure roller 174 is in the distanced position away from the fixing roller 171. In this condition, the contact and separation interlocking cam 90 rotates in the direction indicated by arrow G in conjunction with the contact and separation shaft 113, so that the cam section 90*a* presses the unit swiveling shafts 83. The cleaning unit 80 is pressed by the contact and separation interlocking cams 90 and rotates in the direction indicated by arrow H, separating the cleaning roller 41 from the pressure roller 174.

To switch from cleaning mode to press-contact mode, the contact and separation shaft 113 is rotated in a direction opposite arrow B, thereby rotating the contact and separation interlocking cams 90 and the cleaning unit 80 in that direction, which in turn moves the cleaning roller 41 into contact with the pressure roller 174. In other words, the cleaning roller 41 moves into contact with the pressure roller 174 in conjunction with the contact and separation units 100 press-contacting the pressure roller 174 and moves away from the pressure roller 174 in conjunction with the contact and separation units 100 separating from the pressure roller 174.

As mentioned earlier, in the second embodiment, the toner T that has been transferred from the fixing belt 173 to the pressure roller 174 is removed by moving the cleaning roller 41 into contact with the pressure roller 174 in press-contact mode. In addition, consideration is not need to be given to negative effect of temperature drop because the pressure roller 174 does not contact the unfixed toner T on printing paper P. Furthermore, no damage is inflicted by friction since the cleaning roller 41 is separated from the pressure roller 174 after the pressure roller 174 has stopped rotating.

The present embodiment includes the contact and separation interlocking cams 90 as a structure that moves the cleaning roller 41 into contact with, or away from, the pressure roller 174. The structure is by no means limited to this example and may be an arm coupled to the pivotal members 110 and the unit swiveling shafts 83 or a like member that transmits the contact and separation motion of the pressure roller 174 to the cleaning unit 80.

Figure 11:
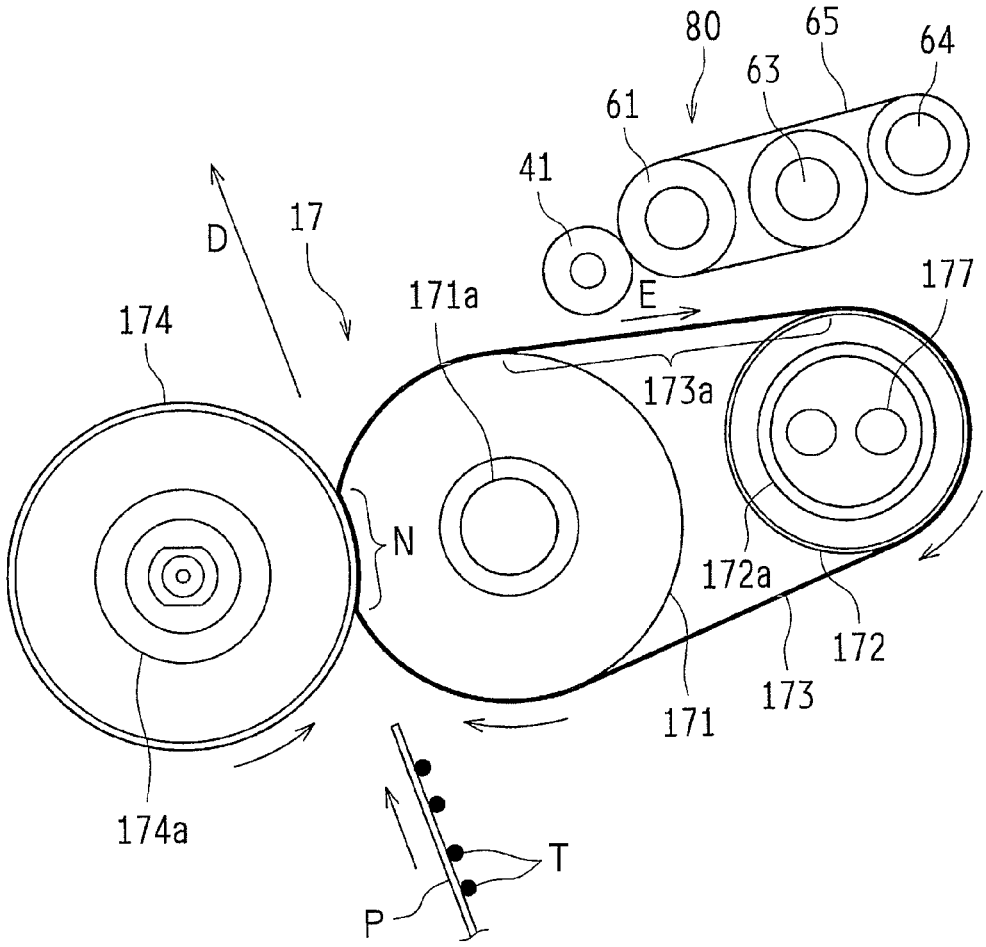
FIG. 11 is a side view of major parts of a fixing device in accordance with the third embodiment of the present invention.
Figure 12:
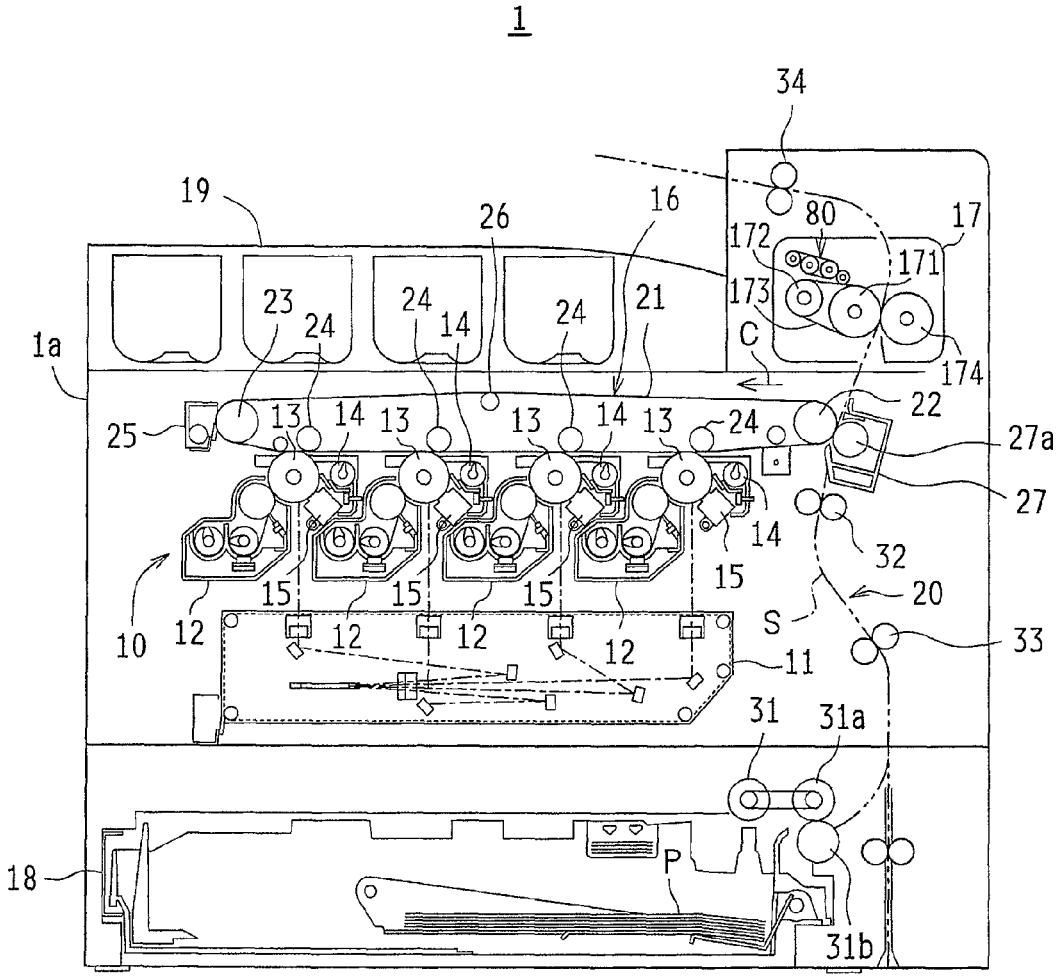
FIG. 12 is a schematic side view of the structure of an image forming apparatus incorporating a fixing device in accordance with the third embodiment of the present invention.

FIG. 11 is a side view of major parts of a fixing device in accordance with the third embodiment of the present invention. FIG. 12 is a schematic side view of the structure of an image forming apparatus incorporating a fixing device in accordance with the third embodiment of the present invention. For the sake of clarity, the contact and separation units 100, the cleaning frames 81, etc. are omitted in FIG. 11. In addition, the members that essentially have the same function and structure as those in the first embodiment and the second embodiment are indicated by the same reference numerals and symbols, and description thereof is omitted.

In the third embodiment, the cleaning unit 80 is located similarly to the first embodiment, so that the cleaning roller 41 can move into contact with, or away from, the fixing belt 173. In other words, the third embodiment differs from the first embodiment in that the cleaning unit 80 is incorporated.

The cleaning roller 41 contacts a non-roller-contact region 173*a* of the peripheral surface of the fixing belt 173 stretched between the fixing roller 171 and the heating roller 172. The fixing belt 173 has on a part of the peripheral surface thereof a planar region that forms a plane. The non-roller-contact region 173*a* is an equivalent of the planar region. The cleaning web 65 is stretched substantially parallel to the planar region. Stretching the cleaning web 65 parallel to the planar region (parallel to the direction in which the fixing device 17 requires an extra length) in this manner allows for a smaller fixing device 17 than when the cleaning web 65 is stretched in another direction.

Figure 13:
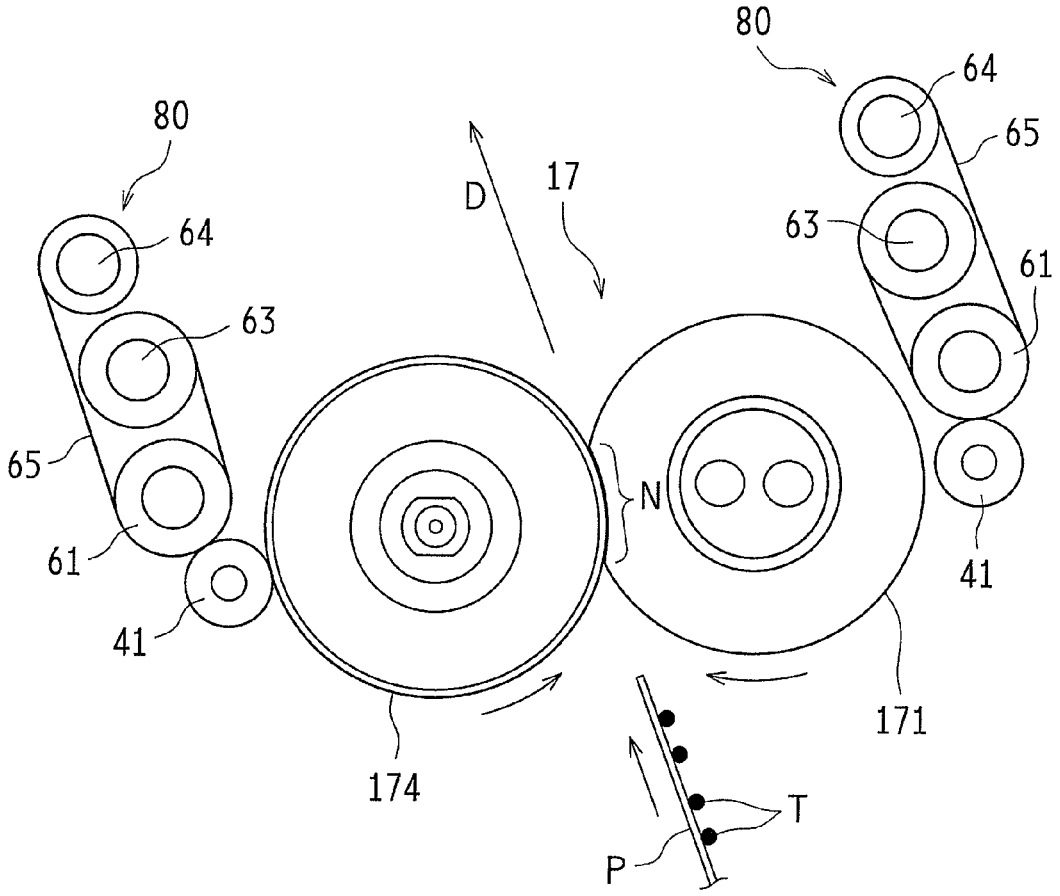
FIG. 13 is a side view of major parts of a fixing device in accordance with the fourth embodiment of the present invention.
Figure 14:
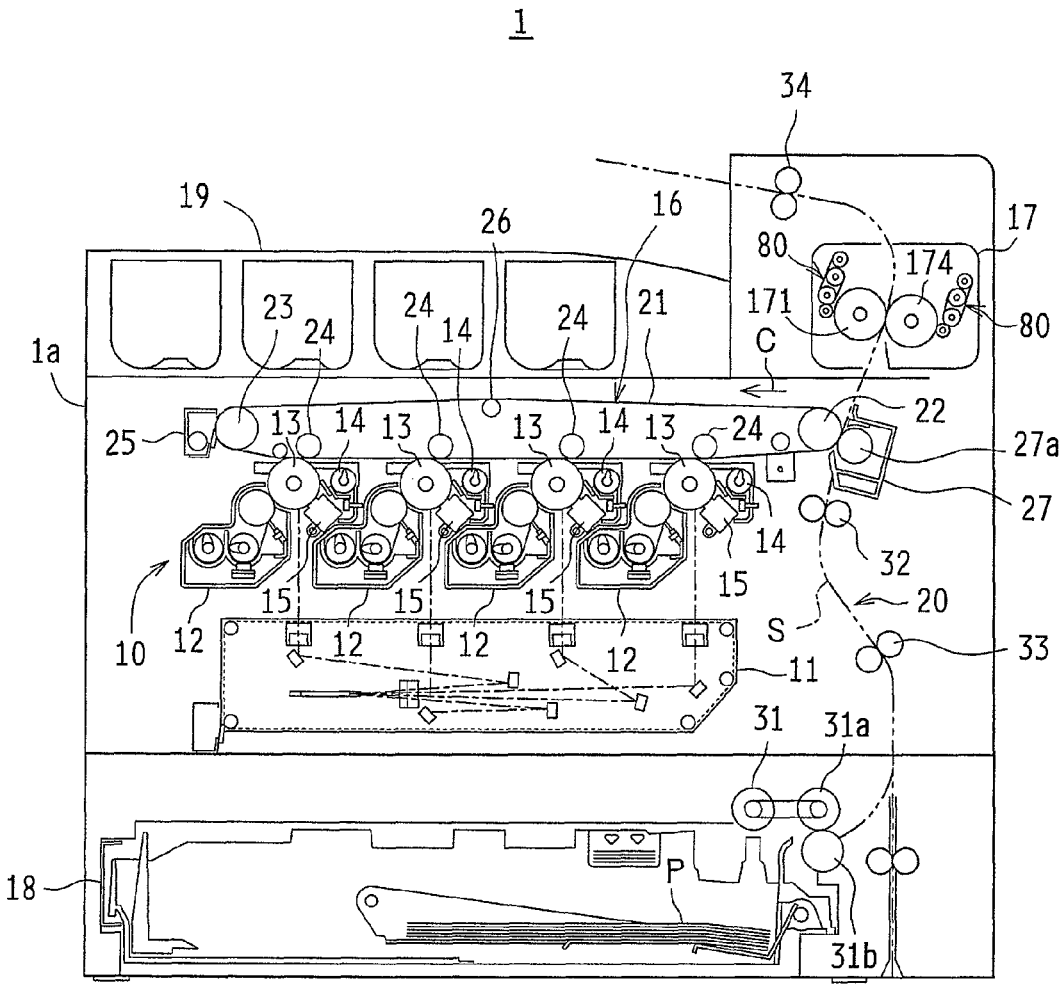
FIG. 14 is a schematic side view of the structure of an image forming apparatus incorporating a fixing device in accordance with the fourth embodiment of the present invention.

FIG. 13 is a side view of major parts of a fixing device in accordance with the fourth embodiment of the present invention. FIG. 14 is a schematic side view of the structure of an image forming apparatus incorporating a fixing device in accordance with the fourth embodiment of the present invention. For the sake of clarity, the contact and separation units 100, the cleaning frames 81, etc. are omitted in FIG. 13. In addition, the members that essentially have the same function and structure as those in the first to third embodiments are indicated by the same reference numerals and symbols, and description thereof is omitted.

The fourth embodiment differs from the second embodiment in that the fourth embodiment further includes a cleaning unit 80 that moves into contact with, or away from, the fixing roller 171. The fixing device 17 is of a type where the pressure roller 174 directly presses the fixing roller 171. When this is the case, the fixing roller 171 preferably has, for example, a built-in heater.

The present embodiment includes a cleaning unit 80 that moves into contact with, or away from, the pressure roller 174 and another cleaning unit 80 that moves into contact with, or away from, the fixing roller 171. Each cleaning web 65 in the two cleaning units 80 is stretched substantially parallel to transport direction D for printing paper. FIG. 13 shows the fixing device 17 in press-contact mode where the pressure roller 174 is in contact with the cleaning roller 41, and the fixing roller 171 is separated from the cleaning roller 41.

The present embodiment includes more than one cleaning unit 80 in a type of fixing device where the pressure roller 174 directly presses the fixing roller 171. The present embodiment is by no means limited to this example; alternatively, the present embodiment may include more than one cleaning unit 80 in a fixing belt type of fixing device.

In the present invention, the cleaning roller 41 may have an oil roller that stores friction-reducing oil. Next, a fixing device 17 in accordance with a fifth embodiment of the present invention incorporating an oil roller will be described in reference to drawings.

Figure 15:
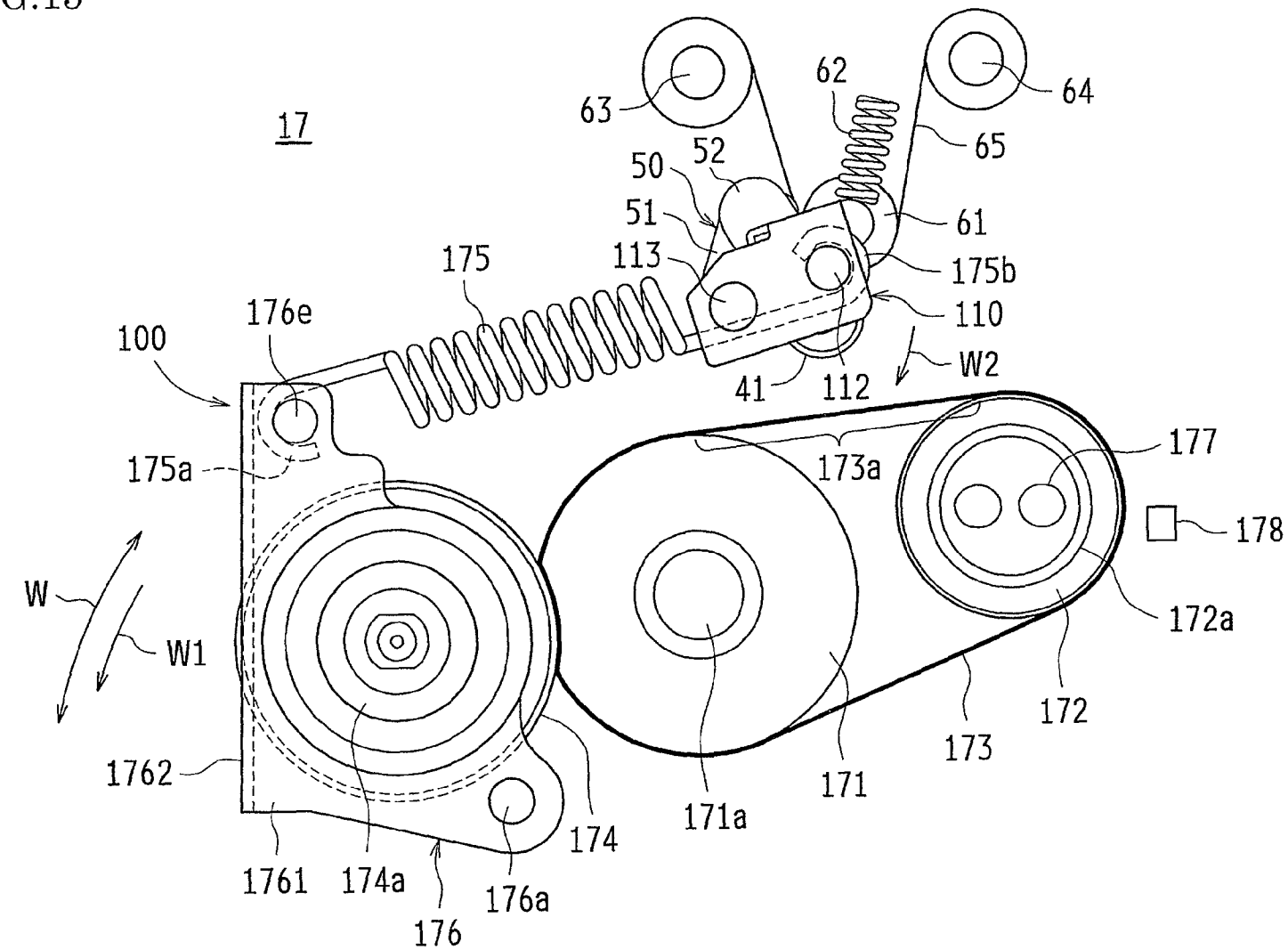
FIG. 15 is a side view of a fixing device in accordance with a fifth embodiment of the present invention.

FIG. 15 is a side view of a fixing device in accordance with the fifth embodiment of the present invention. The main body frame FL is omitted in FIG. 15 for the sake of clarity. In addition, the members that essentially have the same function and structure as those in the first to fourth embodiments are indicated by the same reference numerals and symbols, and description thereof is omitted.

The fifth embodiment differs from the first embodiment in that the cleaning roller 41 incorporates an oil roller.

The cleaning roller 41 includes an oil storage layer 41*b* that stores oil (see FIG. 16; will be described later in detail). The cleaning roller 41, at the ends of the rotational shaft 41*a*, is inserted in regulation holes 71 formed in the main body frame FL. The cleaning roller 41 contacts a non-roller-contact region 173*a*, or a part of the peripheral surface of the fixing belt 173 stretched between the fixing roller 171 and the heating roller 172 downstream of the fixing nip region N. Since the cleaning roller 41 is moved into contact with a part (non-roller-contact region 173*a*) of the backside of the fixing belt 173 that is not in contact with the fixing roller 171 and the heating roller 172, the cleaning roller 41 applies a smaller load on the fixing belt 173.

Figure 16:
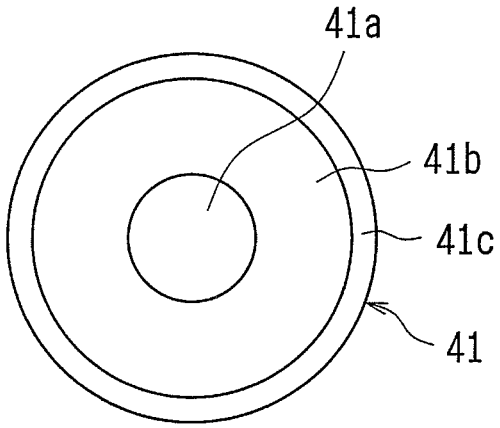
FIG. 16 is an enlarged side view of a cleaning roller for a fixing device in accordance with the fifth embodiment of the present invention.

FIG. 16 is an enlarged side view of a cleaning roller for a fixing device in accordance with the fifth embodiment of the present invention.

The cleaning roller 41 is an oil roller storing oil that reduces friction on the peripheral surface of the fixing belt 173. The cleaning roller 41 includes a rotational shaft 41*a*, an oil storage layer 41*b* covering an outer circumferential surface of the rotational shaft 41*a*, and a surface layer 41*c* covering the outer circumferential surface of the oil storage layer 41*b*. Specifically, the rotational shaft 41*a* is made of aluminum or a like metal and is columnar, but may be shaped as a hollow cylinder. The oil storage layer 41*b* is made of an oil-impregnated porous material and in the present embodiment made of silicone rubber composite sponge impregnated with silicone oil. The surface layer 41*c* may be made of any material with good heat-resistance, durability, and toner releasability and in the present embodiment made of a porous PTFE (polytetrafluoro ethylene).

In the present embodiment, the cleaning roller 41 is an oil roller to reduce friction on the fixing belt 173. However, moving the cleaning roller 41 into contact with the fixing belt 173 could scratch the fixing belt 173 due to friction. Therefore, when no cleaning is being carried out on the fixing belt 173, the cleaning roller 41 is preferably separated from the fixing belt 173.

The embodiments disclosed here are illustrative only and provide no basis for limited interpretation. Therefore, the technical scope of the present invention is determined by the patent claims and should not be interpreted in reference to the embodiments. The technical scope of the present invention encompasses all equivalents and modifications within the scope of the patent claims.

The invention claimed is:

1. A fixing device, comprising:

a rotary member for transporting printing paper;

a pressure member for press-contacting the rotary member to apply pressure onto the printing paper; and at least one cleaning member capable of freely moving into contact with, or away from, a peripheral surface of the rotary member and/or a peripheral surface of the pressure member, wherein a toner image formed on the printing paper is fixed while the printing paper is being held between the rotary member and the pressure member, said fixing device further comprising:

a contact and separation unit for moving the pressure member into contact with, or away from, the rotary member;

a press roller for pressing the cleaning member; and a roller biasing member for biasing the press roller in a bias direction intersecting with contact and separation directions in which the cleaning member moves into contact with, or away from, the rotary member, wherein:

the cleaning member moves into contact with, or away from, the peripheral surface of the rotary member and/or the peripheral surface of the pressure member in conjunction with the contact and separation unit moving the pressure member into contact with, or away from, the rotary member;

the cleaning member is supported to reciprocate freely in the contact and separation directions, is capable of freely moving into contact with, or away from, the peripheral surface of the rotary member, and moves into contact with, or away from, the rotary member in conjunction with the contact and separation unit moving the pressure member into contact with, or away from, the rotary member; and the press roller biases the cleaning member, separated from the rotary member, in one of the contact and separation directions in which the cleaning member moves away from the rotary member.

2. The fixing device as set forth in claim 1, wherein the cleaning member moves away from the rotary member in conjunction with the contact and separation unit press-contacting the pressure member and moves into contact with the rotary member in conjunction with the contact and separation unit separating from the pressure member.

3. The fixing device as set forth in claim 1, wherein:

the contact and separation unit has a contact and separation shaft that can be pivoted to move the pressure member into contact with, or away from, the rotary member; and the cleaning member is supported by a contact and separation interlocking section connected to the contact and separation shaft.

4. The fixing device as set forth in claim 3, wherein:

the contact and separation interlocking section includes a first coupling section pivoting around the contact and separation shaft and a second coupling section pulled by the first coupling section;

the first coupling section is secured at an end thereof to the contact and separation shaft and coupled at the other end to an end of the second coupling section;

the second coupling section supports at the other end thereof a rotational shaft of the cleaning member; and the cleaning member is regulated in terms of range of motion in which the cleaning member moves into contact with, or away from, the rotary member.

5. The fixing device as set forth in claim 1, wherein the press roller biases the cleaning member, being in contact with the rotary member, in the other one of the contact and separation directions in which the cleaning member moves into contact with the rotary member.

6. The fixing device as set forth in claim 1, further comprising a cleaning web stretched by an unwinding roller and a winding roller, wherein the press roller presses the cleaning member via the cleaning web.

7. The fixing device as set forth in claim 1, wherein when the cleaning member is located with a center thereof closer to the rotary member than to a base line in the contact and separation directions, the press roller biases the cleaning member in the other one of the contact and separation directions in which the cleaning member moves into contact with the rotary member, and when the cleaning member is located with the center thereof farther from the rotary member than from the base line in the contact and separation directions, the press roller biases the cleaning member in the one of the contact and separation directions in which the cleaning member moves away from the rotary member, the base line being a straight line parallel to the bias direction and running through a center of the press roller.

8. The fixing device as set forth in claim 7, wherein:

the cleaning member moves between a cleaning position where the cleaning member is in contact with the rotary member and a standby position where the cleaning member is separated from the rotary member;

the cleaning position is closer to the rotary member than to the base line in the contact and separation directions; and the standby position is farther from the rotary member than from the base line in the contact and separation directions.

9. The fixing device as set forth in claim 1, wherein the cleaning member has a rotational shaft supported, with play, by a shaft support section.

10. The fixing device as set forth in claim 1, wherein the cleaning member is capable of freely moving into contact with, or away from, the peripheral surface of the pressure member, and moves into contact with the pressure member in conjunction with the contact and separation unit press-contacting the pressure member and moves away from the pressure member in conjunction with the contact and separation unit separating from the pressure member.

11. The fixing device as set forth in claim 10, wherein the contact and separation unit has a contact and separation shaft that can be pivoted to move the pressure member into contact with, or away from, the rotary member.

12. The fixing device as set forth in claim 1, further comprising:

a cleaning web stretched by an unwinding roller and a winding roller; and a press roller for pressing the cleaning member via the cleaning web.

13. The fixing device as set forth in claim 12, wherein either one of the unwinding roller and the winding roller is disposed substantially interposed between external common tangents of the other one of the unwinding roller and the winding roller and the press roller.

14. The fixing device as set forth in claim 13, wherein the cleaning web is stretched substantially parallel to a transport direction of the printing paper.

15. The fixing device as set forth in claim 13, wherein:

the rotary member and/or the pressure member have a planar region that forms a plane in a part of the peripheral surface(s) thereof; and the cleaning web is stretched substantially parallel to the planar region.

16. The fixing device as set forth in claim 12, wherein the cleaning member is a roller with an oil storage layer for storing oil.

17. The fixing device as set forth in claim 16, wherein:

the rotary member is a fixing belt stretched by a plurality of rollers; and the cleaning member contacts a non-roller-contact region that forms a part of a peripheral surface of the fixing belt stretched by the plurality of rollers.

18. An image forming apparatus, comprising the fixing device as set forth in claim 1.

* * * * *